US007078107B2

(12) United States Patent
Takayama et al.

(10) Patent No.: US 7,078,107 B2
(45) Date of Patent: Jul. 18, 2006

(54) CONTACT MATERIAL, COMPOSITE SINTERED COMPONENT AND METHOD OF PRODUCING SAME

(75) Inventors: Takemori Takayama, Hirakata (JP); Yoshikiyo Tanaka, Hirakata (JP); Tetsuo Onishi, Yawata (JP)

(73) Assignee: Komatsu Ltd. (JP)

( * ) Notice: Subject to any disclaimer, the term of this patent is extended or adjusted under 35 U.S.C. 154(b) by 0 days.

(21) Appl. No.: 10/011,815

(22) Filed: Dec. 11, 2001

(65) Prior Publication Data

US 2002/0172836 A1 Nov. 21, 2002

(30) Foreign Application Priority Data

Dec. 15, 2000 (JP) ..... 2000-382658

(51) Int. Cl.

| | |
|---|---|
| ***F16C 17/12*** | (2006.01) |
| ***F16C 17/24*** | (2006.01) |
| ***B32B 15/01*** | (2006.01) |
| ***B32B 15/18*** | (2006.01) |
| ***B32B 15/20*** | (2006.01) |

(52) U.S. Cl. ..... 428/553; 428/613; 428/676; 428/681; 384/912

(58) Field of Classification Search ..... 428/553, 428/573, 613, 615, 653, 676, 681; 75/230, 75/246; 384/912

See application file for complete search history.

(56) References Cited

U.S. PATENT DOCUMENTS

| | | | | |
|---|---|---|---|---|
| 4,494,027 | A * | 1/1985 | Otto | 310/89 |
| 4,955,791 | A * | 9/1990 | Wrobel | 417/354 |
| 5,478,418 | A * | 12/1995 | Miura et al. | 148/438 |
| 5,821,655 | A * | 10/1998 | Tokushima et al. | 310/90 |
| 6,015,775 | A * | 1/2000 | Takayama et al. | 508/103 |
| 6,089,843 | A * | 7/2000 | Kondoh | 418/179 |
| 6,334,914 | B1 * | 1/2002 | Sakai et al. | 148/433 |
| 6,342,306 | B1 * | 1/2002 | Ozawa et al. | 428/553 |
| 6,354,607 | B1 * | 3/2002 | Kawashima et al. | 280/5.511 |
| 6,428,744 | B1 * | 8/2002 | Takayama et al. | 419/2 |
| 6,467,962 | B1 * | 10/2002 | Suzuki et al. | 384/100 |
| 6,475,635 | B1 * | 11/2002 | Sakai et al. | 428/553 |
| 6,505,971 | B1 * | 1/2003 | Sugimoto et al. | 384/279 |

FOREIGN PATENT DOCUMENTS

| | | |
|---|---|---|
| JP | 5-156388 | 6/1993 |

* cited by examiner

*Primary Examiner*—Jennifer C. Mcneil
*Assistant Examiner*—Jason L. Savage
(74) *Attorney, Agent, or Firm*—Rader, Fishman & Grauer PLLC

(57) ABSTRACT

A contact material which provides improved wear resistance as well as reduced adhesion utilizing the features of an intermetallic compound having an ordered phase, with the intention of (i) improving the seizure resistance and/or wear resistance of an implement bearing which slides under low-speed, high-surface-pressure conditions and is susceptible to lubricant starvation; (ii) preventing abnormal noises; and (iii) achieving prolonged greasing intervals. The contact material contains 10% by volume or more a metallic alloy phase having such a composition range that causes an order-disorder transition. The metallic alloy phase is a Fe base alloy phase containing one or more elements selected from the group consisting of Al, Si, Co and Ni.

13 Claims, 20 Drawing Sheets

FIG. 1
HARDNESS DISTRIBUTION WHEN Fe-Al-Co TERNARY ALLOYS ARE SUBJECTED TO RAPID COOLING AFTER HEATING AT 1,200 °C
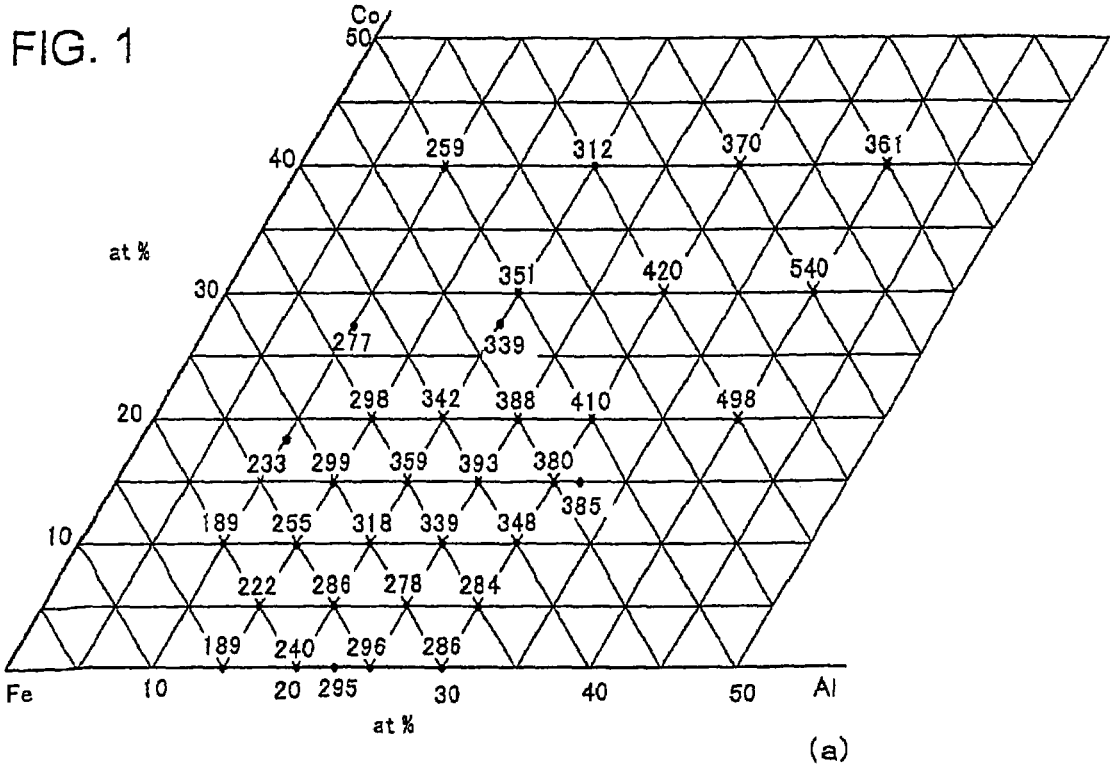
(a)
HARDNESS DISTRIBUTION WHEN 10-HOUR AGING IS DONE AT 600 °C
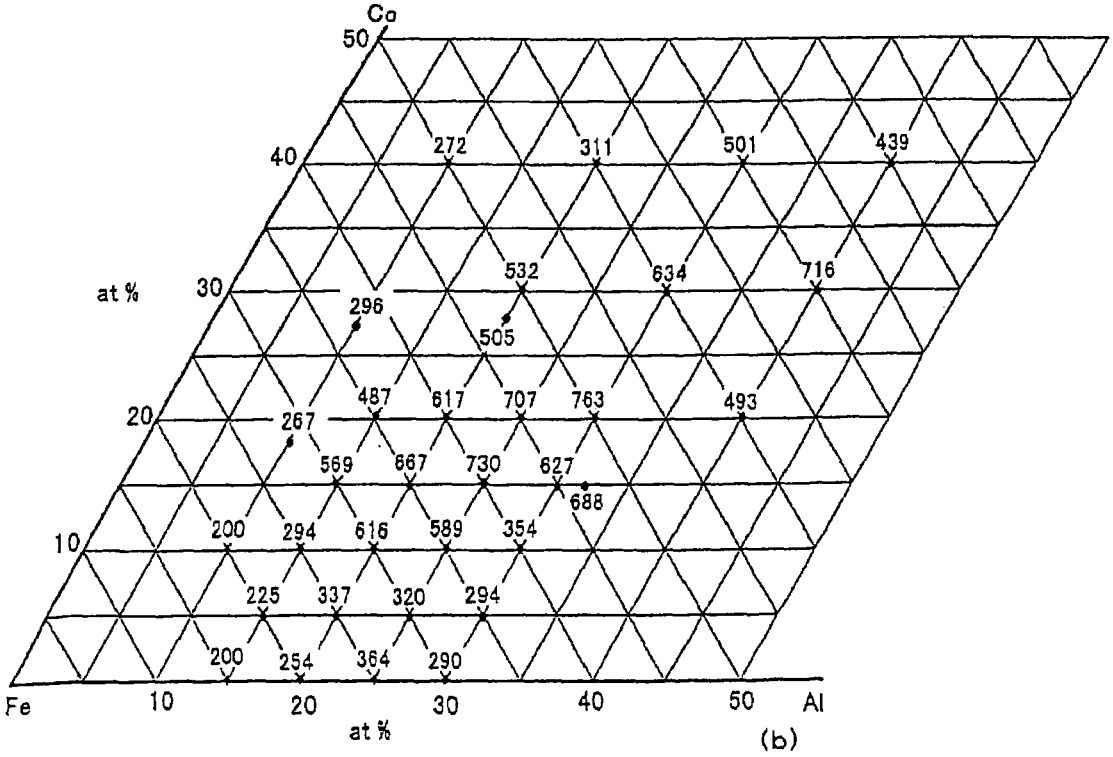
(b)

EFFECT OF ADDITION OF Co UPON HARDNESS OF Fe-Al ALLOYS

CURIE TEMPERATURE OF Fe-Al-10AT% Co ALLOYS

LOAD: 100kg
ROTATIONAL SPEED OF GRINDING STONE: 60rpm
ROTATIONAL SPEED OF SPECIMEN: 10rpm
LUBRICATING OIL: #30 OIL
AMOUNT OF LUBRICATING OIL: 5cc/min
REFERENCE MATERIAL: S45C QUENCHED AND TEMPERED MATERIAL (Hv=500)

HARDNESS OF Fe BASE ORDERED PHASE MATERIALS VERSUS THEIR ABRASION RATIOS

FIG. 7
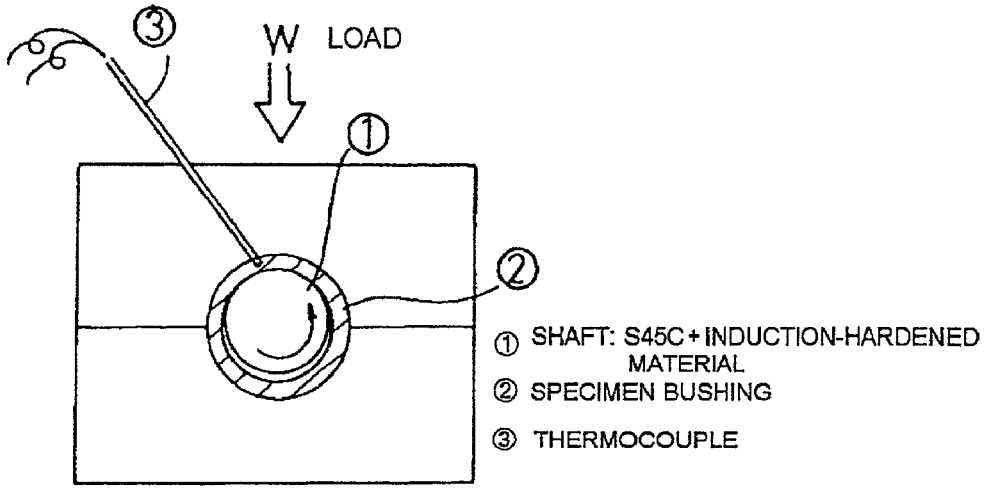
(a)
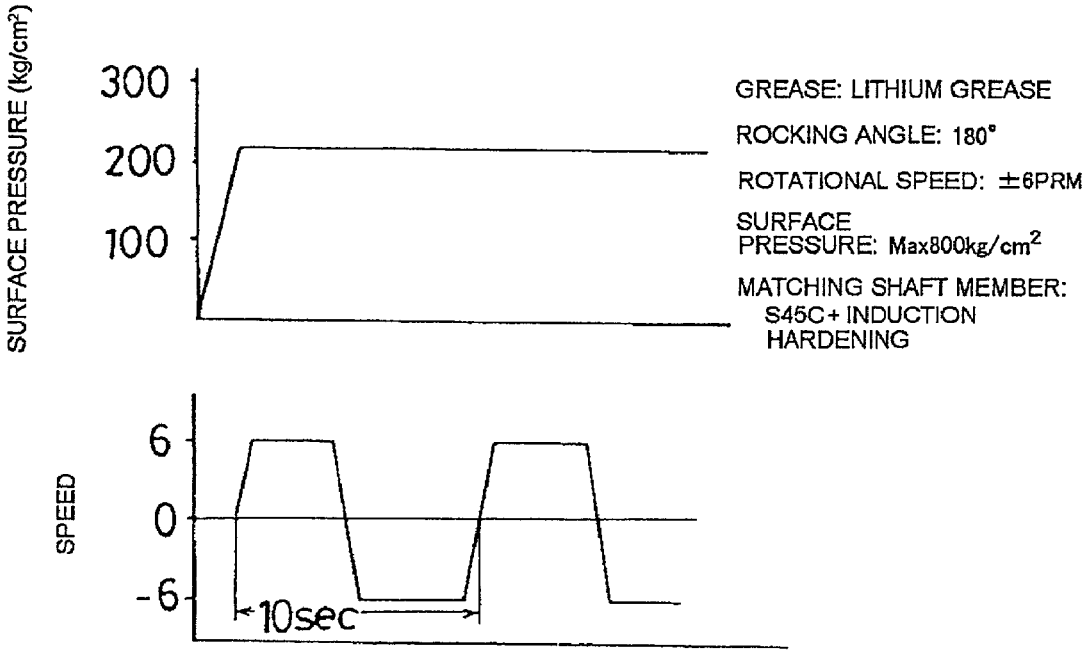
(b)

SLIDING ABRASION AMOUNTS OF Fe BASE ORDERED PHASE MATERIALS

SINTERING PROPERTIES OF FeAlCu BASE MATERIALS (1250°C)

FIG. 14 SINTERED STRUCTURES OF VARIOUS Fe ORDERED PHASE SINTERED ALLOYS
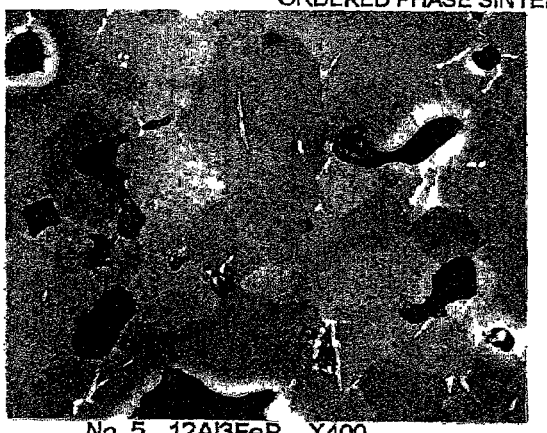
No. 5 12Al3FeP X400
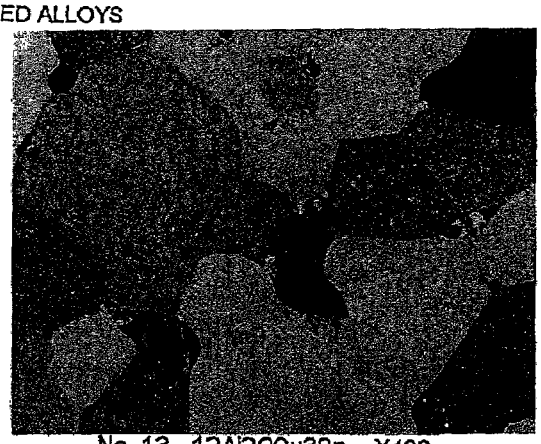
No. 13 12Al20Cu3Sn X400
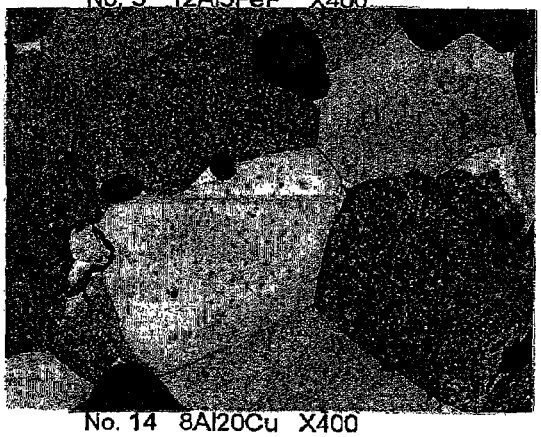
No. 14 8Al20Cu X400
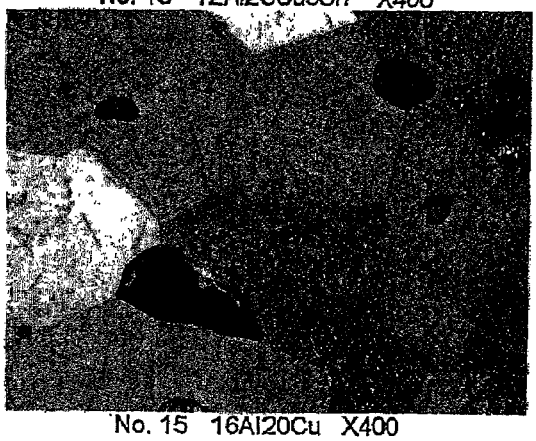
No. 15 16Al20Cu X400
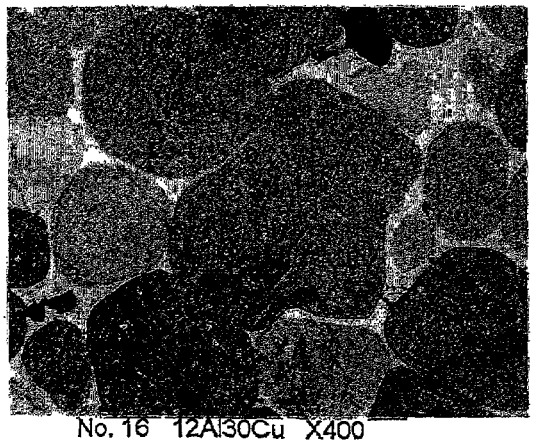
No. 16 12Al30Cu X400

FIG. 15 EFFECTS OF Si, Ni, Co, FeAl ALLOYS UPON SINTER-CONTRACTIBILITY
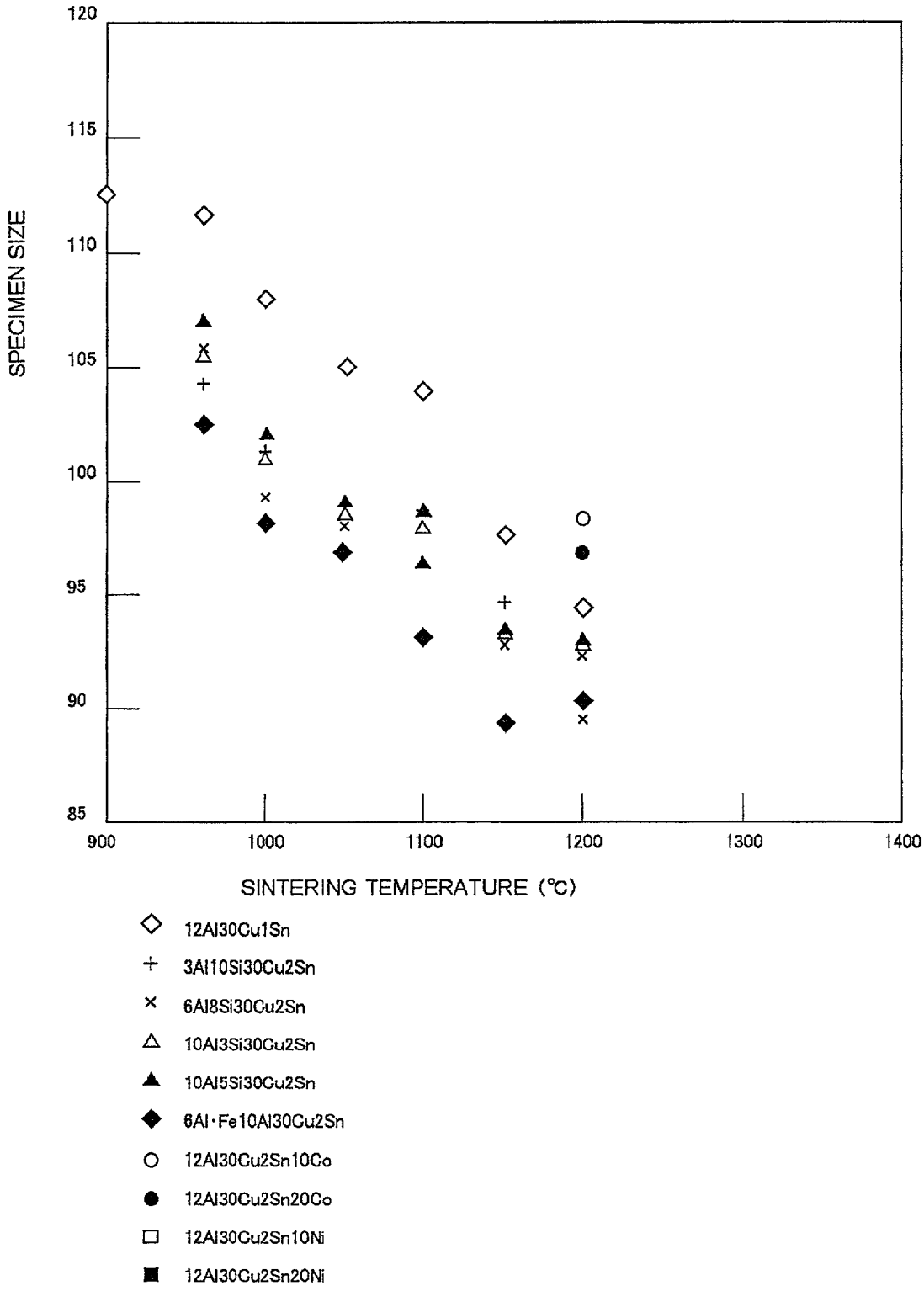

FIG. 16 SEIZURE RESISTANCE OF Fe BASE ORDERED PHASE SINTERED ALLOYS (POROSITY = ABOUT 10% VOLUME)
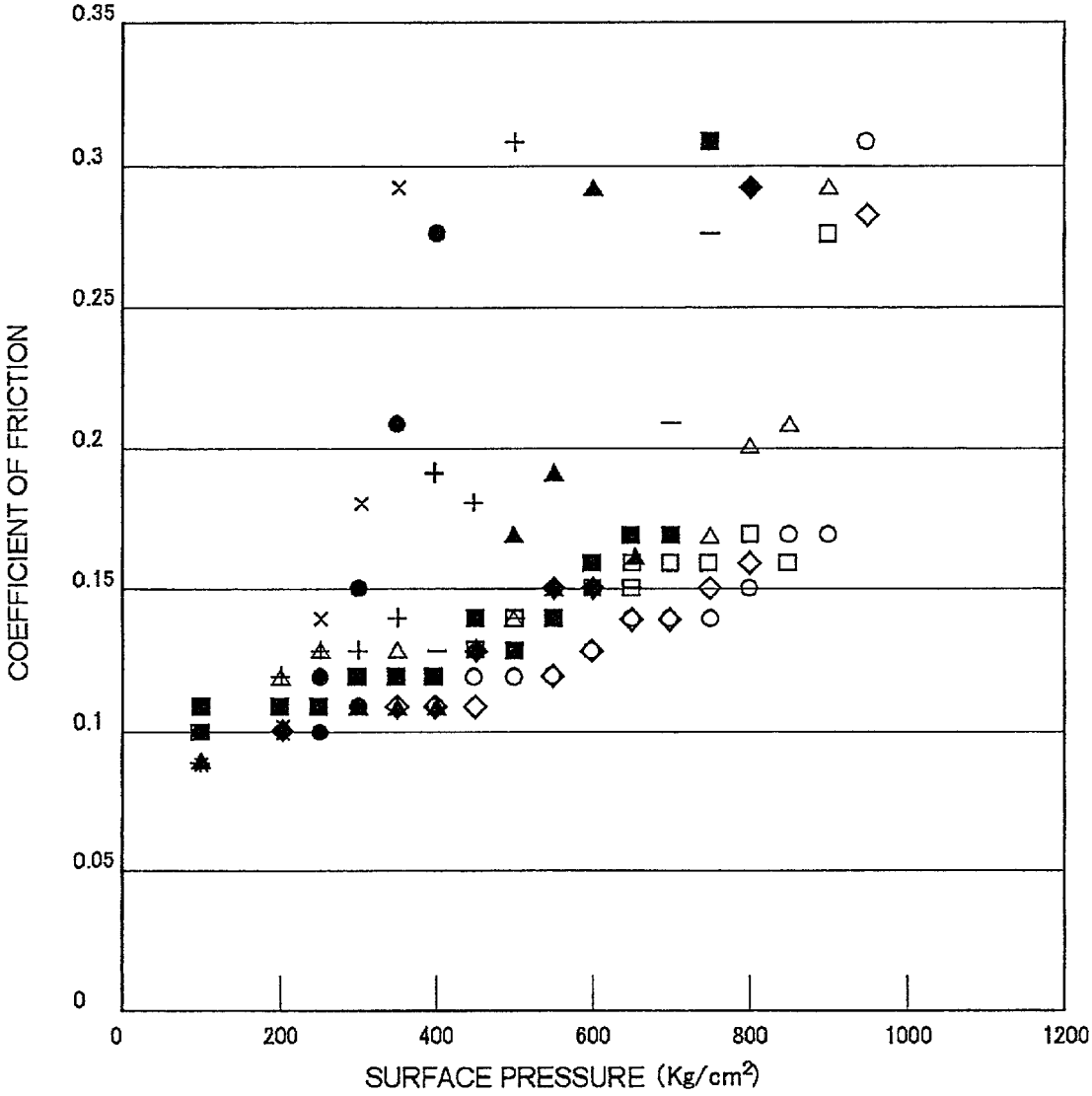
- ● HIGH STRENGTH BRASS QUARTERNARY MATERIAL: COMPARATIVE MATERIAL 3
- △ No5 12Al3FeP
- □ No20 12Al30Cu
- ◇ No29 12Al30Cu10Co
- ○ No31 12Al30Cu10Ni
- × No43 5FeAl
- + No44 10FeAl
- — No45 20FeAl
- ■ No46 30FeAl
- ▲ No47 10FeAlCo
- ◆ No48 20FeAlCo FIG. 17 SEIZURE RESISTANCE OF Fe BASE ORDERED PHASE SINTERED ALLOYS (POROSITY = ABOUT 20% VOLUME)
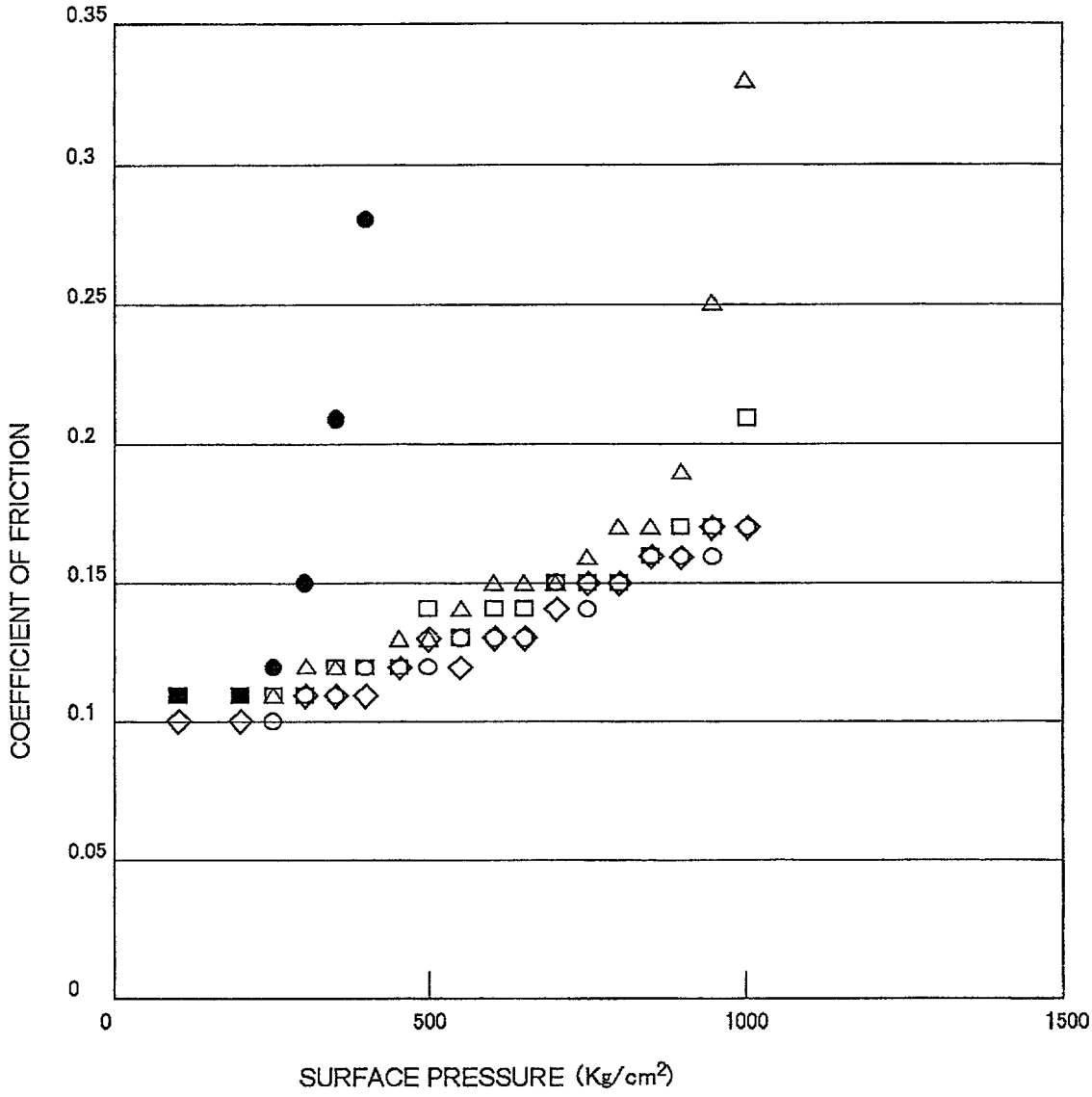
● HIGH STRENGTH BRASS QUARTERNARY MATERIAL: COMPARATIVE MATERIAL 3
△ No5 12Al3FeP
□ No20 12Al30Cu
◇ No29 12Al30Cu10Co
○ No31 12Al30Cu10Ni

TEST CONDITIONS

MATING MEMBER: CARBURIZED AND QUENCHED SCM 420

SURFACE HARDNESS: $H_{RC}$ 60～62

SURFACE COARSENESS: 2.55 OR LESS

LUBRICATING OIL: E001, AMOUNT OF OIL: 250cm$^3$ /min.

OIL TEMPERATURE: 60 ℃

CIRCUMEFERENTIAL SPEED: 10m/sec.

SURFACE PRESSURE: max 800kg/cm$^2$ (50kg/cm$^2$ for each time)

CONTACT MATERIAL, COMPOSITE SINTERED COMPONENT AND METHOD OF PRODUCING SAME

TECHNICAL FIELD

The present invention relates to a contact material, composite sintered contact component and producing method thereof, which are intended for an improvement in the seizure resistance and/or wear resistance of bearings subject to high surface pressure and for prevention of abnormal noise and extension of greasing intervals in such bearings.

BACKGROUND OF THE INVENTION

As bearings subject to higher surface pressure and lower speed conditions (such as bushings for implements mounted on construction machines), steel bushings, which have been carburized or induction-hardened to attain wear resistance as an important feature, are presently used in grease-lubricated situations. Since the lubricating conditions, in which such implements for construction machines are used under high surface pressure, are particularly harsh, unpleasant abnormal noises occur when the implements are in service. As measures for avoiding noises, a lubricating film is applied to the sliding contact surfaces of the steel bushings, or a multiplicity of grease grooves are made for promotion of grease lubrication.

Oil retaining sintered bearings made from iron base (typically Fe—C—Cu base) sintered contact materials are sometimes used in part of implements subject to low load. These iron base sintered contact materials include a hard martensitic matrix and pores formed in the matrix, the pores being impregnated with a lubricating oil. Some of them further contain softer tool powder or ceramic powder.

As copper base sintered bearing materials, bronze base materials such as Cu—Sn—Pb and lead-bronze base materials are commonly used in the roller section of the base carrier of a construction machine. On the other hand, high strength brass bushings, which are harder and stronger than these materials, are employed in part of implements, thanks to their excellent seizure resistance and conformity.

In order to extend greasing time intervals at which grease is fed to the bearing section of an implement, bearings such as "500SP" produced by OILES CORPORATION. are used in some cases. In such bearings, a high strength brass bushing is provided with machining holes whose area is about 30% of the sliding contact area and these holes are so arranged as to be overlapped with one another in a sliding direction and filled with graphite as a solid lubricant. For the same purpose, sintered metal bodies such as "SL Alloy" produced by TOSHIBA TUNGALOY CO., LTD., to which a large amount of solid lubricant is added, are sometimes used.

A double-layered sintered contact component used under high surface pressure conditions and a producing method thereof are disclosed in Japanese Patent Publication (KOKAI) No. 5-156388 (1993). This double-layered sintered contact material contains graphite as a solid lubricant within the range of from 3 to 8 wt % and comprises an aluminum-bronze base sintered contact alloy which is integrally bonded to a steel plate with a joint layer of phosphor-bronze plate therebetween and which contains 5 to 13 wt % Al, 3 to 6 wt % Fe and 0.1 to 1.5 wt % TiH.

Lubricating film forming conditions for contact components that slide under high surface pressure at extremely slow speeds like bushings used for the implements of working machines are extremely severe. The above steel bushings are hard enough to withstand high load, but present the serious drawback that they are susceptible to seizure and unpleasant abnormal noises so that control is needed to prevent seizure and noises by shortening greasing time intervals.

The above implement bushings formed from the oil-retaining iron base sintered contact materials having a martensitic matrix do not fatigue and are improved over the steel bushings in terms of seizure resistance. However, they suffer from the problem that when they are used under extremely slow and high load conditions such as encountered by implements, lubricant starvation tends to occur and as a result, satisfactorily improved seizure resistance and prevention of abnormal noises cannot be ensured.

The contact components made from the sintered contact materials, which are provided with pores impregnated with a large amount of lubricant for improving the lubricating condition during sliding, have also failed in improving seizure resistance and prevention of abnormal noises as much as expected, because the lubricating condition gets all the worse for the provision of a number of pores within the sintered body.

Where a bronze base material (e.g., Cu—Sn and Cu—Pb), which is a material composed of dissimilar constituents, is used with the intention of increasing resistance to seizure caused between an implement steel pin and an implement bushing, the material becomes fatigued under high surface pressure and tends to wear away very soon because of the severe lubricating condition.

Where a cast high-strength brass material, which is harder and stronger than the bronze base material, is applied for an implement bushing, substantially no fatigue is caused and occurrence of abnormal noises can be prevented to a considerable extent compared to the case of the steel bushings. However, lubricant starvation easily occurs as pointed out earlier so that satisfactory improvements in seizure resistance and protection against abnormal noises cannot be expected.

In cases where graphite having high self-lubricity is embedded in a cast high-strength brass bushing and the graphite is impregnated with a lubricating oil for achieving increased greasing ability and prolonged greasing intervals, the area percentage of the holes to be filled with graphite is normally limited to 25 to 30%, so that the area over which the lubricant is spread decreases as the sliding distance decreases, resulting in occurrence of local seizure and a failure to ensure satisfactory self-lubricity for a long time. In addition, the processes of machining to make the holes for graphite and filling the holes with graphite lead to a considerable increase in the cost.

Further, the technique such as disclosed in Japanese Patent Publication No. 5-156388, in which graphite is added as a solid lubricant to a high-strength aluminum bronze sintered material in a large amount of 3 to 8 wt % (about 12 to 36% by volume) in order to ensure improved seizure resistance, has not proved successful in that brittleness due to the large graphite content leads to poor sliding properties under high surface pressure and insufficient wear resistance.

Metallic sintered bodies containing large amounts of solid lubricant are difficult to be sintered and therefore require pressurization treatment during sintering to achieve practical strength. For instance, in the case of the above-described double-layered sintered contact component formed by integrally bonding an Al bronze base sintered contact material containing 3 to 8 wt % graphite to a backing with a phosphor bronze material therebetween, pressurization treatment is needed in the sintering process and at least the integration process inevitably causes an increase in the cost.

The present invention is directed to overcoming the foregoing problems and a primary object of the invention is therefore to provide a contact material which provides improved wear resistance as well as reduced adhesion by virtue of the features of an intermetallic compound having an ordered phase, with the intention of (i) improving the seizure resistance and/or wear resistance of an implement bearing which is subject to low-speed, high-surface-pressure conditions when sliding and is susceptible to lubricant starvation; (ii) preventing abnormal noises; and (iii) achieving prolonged greasing intervals. Another object of the invention is to provide a composite sintered contact component in which the above-described contact material is integrated with a backing and a method of making the same.

DISCLOSURE OF THE INVENTION

In view of the necessity for imparting proper hardness as well as superior seizure resistance and/or wear resistance to bearing materials for implements used in a low-speed, high-surface-pressure, sliding contact condition liable to lubricant starvation, the invention has clarified that materials having the above properties contain a metal alloy phase having a composition range which causes an order-disorder transition and, more particularly, a Fe base alloy ordered phase.

Specifically, according to a first aspect of the invention, there is provided a contact material which contains 10% by volume or more a metal alloy phase having a composition range which causes an order-disorder transition. According to a second aspect of the invention, there is provided a contact material which is obtained by modifying the first aspect such that the metal alloy phase is a Fe base alloy phase containing at least one element selected from the group consisting of Al, Si, Co and Ni.

It is understood from the HANSEN phase diagram that examples of Fe base alloys practically used for bearings and having an ordered phase are Fe—Al, Fe—Si, Fe—Co and Fe—Ni. In view of cost performance, alloys based on Fe—Al or Fe—Si are very useful.

Examples of Fe—Al base alloys and Fe—Si base alloys having an ordered phase are $Fe_3Al$, FeAl, $Fe_3Si$, and FeSi. It is well known that each of these crystals has a BCC structure in which Fe atoms, Al atoms and/or Si atoms extremely strongly attract one another such that they are regularly arranged in the closest proximity to one another, and therefore, the hardness of the ordered phase becomes similar to that of intermetallic compounds as the degree of order increases. In addition, since the phase separation into two kinds of ordered phases, that is, the phase separation into Fe—Al and Ni—Al or Co—Al is involved in Fe—Al base alloys to which Ni and Co have been added, the alloys can be significantly hardened by applying aging treatment at e.g., 600° C. or by slowing the cooling speed down after sintering. This is very useful for imparting wear resistance. However, the Vickers hardness of these ordered phases does not exceed Hv 800 and if these alloys are used as contact material, there is such a merit that the aforesaid implement pin (i.e., corresponding mating contact member) is not attacked by the bushing formed from the contact material and the contact component itself exhibits excellent wear resistance, because the surface of the implement pin has been hardened by thermal treatment.

As assumed from the fact that the ordered phases have hardness similar to that of intermetallic compounds, an extremely stable structure can be obtained by regularly arranging Fe atoms and Al atoms and/or Si atoms. On the other hand, if the atomic arrangement is disturbed by adhesion, the structure becomes very unstable. It is therefore apparently desirable for the properties of the contact material in a chemical sense to reduce the adhesion of the implement pin made from steel.

Additionally, in view of the fact that the order-disorder transition stage, at which an ordered state of atoms is changed to a disordered state, is accompanied by remarkable endothermic reaction, it is preferable that the contact material of the invention functions to restrict heat generation at the sliding contact surface. In cases where the temperature of the sliding contact surface is not raised by significant adhesion but by friction heat, the endothermic reaction within the wide range of secondary order-disorder transition temperature is preferably utilized so that adhesion resistance can be improved.

In addition, since a remarkable endothermic reaction similar to the order-disorder transition is caused by the magnetic transition in which a ferromagnetic substance is secondarily transformed into a paramagnetic substance, the contact material of the invention can be designed for improved adhesion resistance such that further secondary-transition-like, extremely remarkable endothermic reaction is caused within a wide temperature range, for instance, by controlling order-disorder transition temperature and magnetic transition temperature.

The Fe base alloy phase of the second aspect of the invention preferably contains Fe as a chief component and at least 5 to 30 wt % Al (a third aspect of the invention). The Fe base alloy phase may contain Fe as a chief component and at least 5 to 15 wt % Si (a fourth aspect of the invention). Further, the Fe base alloy phase may contain Fe as a chief component and 5 to 20 wt % Al and Si (a fifth aspect of the invention).

Preferably, the Fe base alloy phase of any one of the second to fifth aspects contains at least one element selected from the group consisting of Co and Ni in an amount of 5 to 40 wt % and has a hardness of Hv 300 to 800 (a six aspect of the invention). Further, the Fe base alloy phase of any one of the second to sixth aspects may be arranged so as to have an order-disorder transition temperature and/or magnetic transition temperature of 200° C. to 900° C. (a seventh aspect of the invention).

Each of the foregoing aspects may be designed such that at least Cu is contained in an amount of 10 to 90 wt % and the Fe base alloy phase and Cu alloy phase are dispersed in an amount of 10% by volume or more within the structure of the contact material (an eighth aspect of the invention). The Fe alloy ordered phase is thus connected by use of the Cu base material, whereby the hardness of the contact material can be properly adjusted according to the condition in which the contact material is used as a bearing and also, its toughness can be adjusted. The Fe base alloy ordered phase can exert its effect when its amount is 10% by volume or more and the remaining phase is composed of the Cu base material containing Cu as a chief component. Further, the eighth aspect is preferably designed to comprise at least two phases which are a Fe base phase causing an order-disorder transition and a Cu base phase containing Cu as a chief component, the Cu base phase being comprised of the (alpha+beta) phase and/or beta phase shown in the Cu—Al phase diagram (a ninth aspect of the invention).

The provision of a large number of lubricating oil retaining pores, which are dispersed inside a bearing with the aim of uniformly supplying lubricating oil to the sliding contact surface of the bearing, not only increases the seizure resistance of the bearing, but also significantly prolongs the greasing intervals of the bearing. In this case, the material of the bearing is produced by sintering and composed of a Fe base ordered phase alloy and/or the above Cu base material plus a Fe base ordered phase. In view of this, the bearings formed according to the invention are mostly formed from a sintered material having pores.

Specifically, the porosity of the material associated with each of the foregoing aspects is preferably adjusted to be 5 to 35% by volume (a tenth aspect of the invention). Normally, it is preferable that the pores provided for oil retaining bearing sintered contact material be air holes, and in view of this, the porosity of the contact material, which provides sufficient ventilating air, is set to 5% by volume or more in the invention. Although the upper limit of porosity can be set quite freely in relation to the surface pressure to be applied to the bearing, because oil retention can be improved by increasing the viscosity of the lubricating oil, the porosity of the contact material of the invention is determined so as not to exceed 35% by volume for fear that the material becomes too weak in strength. In addition, where a large number of pores are contained as described earlier, it is effective to impregnate the contact material with a resin having superior lubricity such as PA (polyamide).

When producing a sintered material having a Fe base ordered phase as a chief component, it is preferable to compact and sinter a mixture of Cu powder and Fe base alloy powder having a composition similar to that of the Fe base ordered phase. However, there are difficulties in the availability of the Fe base alloy powder and in the compactibility of these powders because of their hardness, in addition to the poor cost performance of the powders. To overcome the difficulties, mixing, compacting and sintering of a blend of primary powders such as Fe, Al, Si, Ni, Co and Cu are required. However, if a blend of Fe powder and Al powder is sintered subsequently to compacting, the powder blend will be significantly expanded, presenting difficulties in sintering. The invention is therefore designed to easily produce a Fe—Al base ordered phase sintered contact material and ordered phases from Cu base constituents by controlling the above significant expansion through utilization of the following measures in combination, which are: (1) sinterability is enhanced by increasing reducibility while allowing a liquid phase to partially appear, through addition of 0.25 wt % one element selected from the group consisting of phosphor (iron), Si and Ti. (2) sinterability is enhanced by creating a Cu base liquid phase in an initial stage of sintering by adding 10 wt % or more Cu powder. (3) sinterability is enhanced by adding, in an amount of up to 10 wt %, elements (e.g., Sn, Si, phosphor and Mn) which are dissolvable into Cu powder in a solid state, thereby to lower the melting point of the Cu powder.

According to the invention, compactibility is ensured by mixing the hard Fe—Al base alloy powder with the soft Cu powder which is added in an amount falling within the above range. Since up to about 25 wt % Cu can be dissolved in a Fe base ordered phase during sintering, it is anticipated that a fine Cu base phase precipitates within a Fe—Al ordered phase of a contact material containing 10 wt % or more Cu, when the contact material is cooled down from a sintering temperature or subjected to aging treatment at low temperature. However, the hardness of the ordered phase itself is satisfactorily exerted and therefore no problems arise in sliding properties. This means that the precipitation of this Cu base phase gives virtually no influence on the above-described "order".

Accordingly, it is preferable to modify the tenth aspect such that one or more elements selected from the group consisting of Sn, P, Ti and Mn is added in an amount ranging from 0.1 to 10 wt % (an eleventh aspect of the invention).

In addition, in the case of a structure in which a Fe base alloy ordered phase is linked by a Cu base material, Al and Si are dispersed and dissolved in the Cu base phase so that the Cu base phase is strengthened by Al and Si. As the present applicant has already disclosed in Japanese Patent Application No. 2000-86080, it is preferable that the harder beta phase (BCC) shown in the Cu—Al phase diagram be contained and that at least the Cu phase contains 8 wt % or more Al. Preferably, there coexist one or more elements selected from the group consisting of Sn, Ti, Ni, Mn, Si, and P which enhance the sliding properties.

It has been found from a study on the composition distribution of the aforesaid structure in which a Fe—Al base alloy ordered phase is linked by a Cu base material, by use of an EPMA (X ray microanalyzer analysis), Al and Ti are condensed in the Fe ordered phase rather than in the Cu base phase, while Sn is condensed in the Cu base phase and P is substantially uniformly dissolved in a solid state. In addition, it has been found that the concentration of Cu dissolved in a solid state into the Fe—Al ordered phase is 25 wt % as discussed earlier while the concentration of Fe dissolved in a solid state into the Cu phase reaches about 5 wt %.

It can be easily understood that Sn is virtually undissolved in a solid state into the Fe—al ordered phase but condensed in the Cu base phase, increasing the sliding properties of the Cu base phase. As disclosed by the present applicant in Japanese Patent Application No. 2000-86080, this Sn functions to considerably stabilize the Cu—Al base beta phase and to make the beta phase likely to appear, while lowering the melting point of the Cu base phase, thereby enhancing sinterability. However, where Sn is added in a large amount in the presence of Al, a large amount of intermetallic compound precipitates, leading to significant brittleness. In view of this, the maximum amount of Sn to be added is determined to be 10 wt % in the invention.

Although Si enhances sinterability to a considerable degree like Sn, a Cu base phase becomes hard and brittle where 3 wt % or more Si is concentrated within the Cu base phase in the presence of Al. Therefore, it is preferable for the bearing material to limit the amount of Si to 5 wt % or less.

Apart from the above-discussed constituents, it is preferable to add one or more selected from the group consisting of elements such as C, Cr, Pb, Zn, Be, Mo, W, Mg and Ag; solid lubricant such as graphite, MnS and $CaF_2$; and hard dispersion materials such as ceramics, in order to improve sinterability, sliding properties and strength and to adjust porosity (a twelfth aspect of the invention).

The Fe—Al base ordered phase has excellent functions as a magnetostorictive material and causes significant energy adsorption due to a big change in magnetization when it is subjected to high mechanical pressure (i.e., elastic deformation). Thus, the Fe—Al phase ordered phase is suitably used for absorbing a local excessive force generated during sliding and addition of such an alloy element that improves magnetostorictive properties is highly encouraged.

According to a thirteenth aspect of the invention, the sintered contact material of the first aspect is integrated with a sheet-like, cylindrical or substantially cylindrical backing made from an iron base material.

According to a fourteenth aspect of the invention, the sintered contact material of the thirteenth aspect is sinter-bonded to the backing in independently dispersed island form in an amount of 30 to 70% by area with respect to the area of the backing, and the recesses formed between the independent islands of the contact material are filled with grease or a solid lubricant while the contact material is sliding. It is apparent that this arrangement has the effect of achieving dramatically prolonged greasing intervals. In this case, it is desirable to make the length of each of the recesses between the islands be twice or more the distance between the joint surface of the backing and the sliding contact surface of the contact material in order to prevent each island from peeing from the joint surface under higher surface pressure sliding contact condition. It should be noted that the aforesaid length of each recess extends in parallel with the sliding direction of the contact component.

According to a fifteenth aspect of the invention, the sintered contact material of the thirteenth aspect is holed, making independent recesses in an amount of 30 to 70% by area with respect to the area of the backing and sinter-bonded to the backing, and the recesses are filled with grease or a solid lubricant while the contact material is sliding.

The thirteenth aspect of the invention may be arranged such that reservoir grooves for lubricating oil are preformed in the joint surface of the backing (a sixteenth aspect of the invention). This arrangement enables an remarkable increase in oil content when the sintered contact material is utilized for forming an oil-less bearing, and is therefore effective for extension of the greasing intervals. Preferably, the iron base material of the backing has a porosity of 5 to 30% by volume so that the backing portion of the contact component also retains oil (a seventeenth aspect of the invention). The porosity is determined to be 5 to 30% by volume for the reason that if the porosity is less than 5% by volume, the opening of the pores is insufficient for ensuring increased oil content, and if the porosity exceeds 30% by volume on the other hand, the backing becomes too weak in sinter strength.

The foregoing sintered contact material is preferably sinter-bonded to the backing through a third insert material (an eighteenth aspect of the invention). Such sinter bonding through the third insert material excellent in sinter bondability, which is accompanied with generation of a liquid phase in the sintered contact material at a sinter bonding temperature, is desirable because it considerably alleviates the limitation on the composition of the sintered contact material of the invention. Preferable examples of the third insert material discussed herein are bronze base sintered bodies containing Sn and Fe—Cu—Sn base sintered bodies (see Japanese Patent Application No. 2000-86080).

The thirteenth to eighteenth aspects may be modified such that the backing may be provided with a collar so as to slide when it is subjected to a thrust load and a wear-resistant material or contact material is integrated with the sliding contact surface of the collar (a nineteenth aspect of the invention). In this case, the wear-resistant material or contact material is one selected from the group consisting of hard metals, stellite, iron base wear-resistant materials, ceramics and wear-resistant Cu infiltrated materials, and such a material is integrated by one means selected from thermal spraying, brazing, sinter-bonding, infiltration and adhesion (a twentieth aspect of the invention). Although brazing and adhesion are preferable because of their simplicity, it is necessary to apply such means after completion of sintering in cases where the contact material is a sintered contact material.

In the case of a composite sintered contact component formed by integrating a contact material with a backing, the contact material containing Sn and Cu incorporated in a Fe base ordered phase alloy containing at least 5 wt % Al, Al and Sn tend to cause negative segregation, and an enriched Sn phase is generated at the boundary face between the contact material and the backing by the Al contained in the contact material as disclosed by the present applicant in Japanese Patent Application No. 2000-86080, so that bonding of the contact material with the backing is facilitated. By virtue of addition of Ti, Ni, phosphor iron, NiP, Mn and Si which restrict the sweat of Sn, wettability at the joint surfaces and, in consequence, bondability can be improved.

The above composite sintered contact component is produced by a method according to a twenty-first aspect of the invention. The method is for producing a composite sintered contact component by integrating a sintered contact material with a cylindrical or substantially cylindrical backing, the sintered contact material having 10% by volume or more a Fe base alloy phase which causes an order-disorder transition, the backing being made from an iron base material, wherein the sintered contact material contains metallic Al which causes expansion of the sintered contact material and 10 to 70 wt % Cu which is used as an element for generating a liquid phase within a high temperature zone to ensure sinter strength and sinter bondability, wherein a compact made from the sintered contact material is a cylindrical component having an outer diameter equal to or slightly smaller than the inner diameter of the backing, and wherein when the cylindrical component is heated to 900° C. or more, being inserted into the backing, (a) the sintered contact material is expanded by heating at a temperature of 800° C. or more for a specified period of time and bonded to the backing by utilizing a Cu base alloy liquid phase which has been generated at the expansion temperature, and (b) the sintered contact material is further heated at a temperature of 900° C. or more thereby generating more Cu base alloy liquid phase to compact the sintered contact material.

It should be noted that the amount of Al metal primary powder to be added does not necessarily have to be the total amount of Al contained in the Fe—Al ordered phase alloy. Since substantially good bondability can be attained as long as a dimensional expansion amount of 1% or more is ensured, it suffices to make the addition of Al metal powder meet this condition.

The twenty-first invention may be modified such that a third insert material is interposed between the cylindrical or substantially cylindrical backing made from the iron base material and the cylindrical compact made from the sintered contact material and having an outer diameter slightly smaller than the inner diameter of the backing, whereby a liquid phase component is generated which is useful for bonding the sintered contact material to the backing when heating the sintered contact material at 800° C. or more so as to be expanded (a twenty-second aspect of the invention). Preferably, the third insert material is adjusted such that the whole of it does not become a liquid phase at the above bonding temperature and is an alloy material containing Sn and Cu which exhibit excellent wettability with respect to the above iron base material (a twenty-third aspect of the invention). With this arrangement, the liquid phase generated from the third insert material prevents rapid penetration into the sintered contact material and into the backing made from an iron base material so that stable bondability can be ensured.

The twenty-first and twenty-second aspects may be arranged such that the backing is provided with a collar and a wear-resistant material or the sintered contact material is integrated with the sliding contact surface of the collar by one means selected from brazing, sinter-bonding and infiltration, simultaneously with the integration of the backing (a twenty-fourth aspect of the invention). This contributes to a reduction in the production cost.

A high-carbon, high-Cr base alloy sintered material containing at least 1.5 to 3.5 wt % carbon and 5 to 17 wt % Cr is sinter-bonded to the sliding contact surface of the collar simultaneously with the integration of the wear-resistant material or the sintered contact material (a twenty-fifth aspect of the invention). In this case, the following is known to be desirable: A proper sintering temperature is obtained by adding 0.1 to 0.5 wt % P and 0.5 to 5.0 wt % Si and Mo to a base comprising at least 1.5 to 3.5 wt % carbon and 5 to 17 wt % Cr. An adjustment of sinterability etc. is made by further adding 0.5 to 5.0 wt % Ni, V, W and Co.

According to a twenty-sixth aspect of the invention, there is provided a method for producing a composite sintered contact component by integrating a sintered contact material with a sheet-like backing made from an iron base material, the sintered contact material containing 10% by volume or more a Fe base alloy phase which causes an order-disorder transition, wherein the sintered contact material contains the Fe base alloy phase which causes an order-disorder transition and at least 10 to 70 wt % Cu and 3 to 10 wt % Sn which serve as elements for generating a liquid phase within a high temperature zone to ensure sinter strength and sinter-bondability, and wherein a powder blend for producing the sintered contact material is dispersed onto the surface of the backing, and after sintering in a neutral, reduced or vacuum atmosphere, a sintered layer formed on the backing is compressed with a rolling mill or a press and then subjected to a re-sintering process at least once in the neutral, reduced or vacuum atmosphere, whereby sinter-bonding is carried out.

For integrating the sintered contact material with the sheet-like backing, it is preferable to employ the above inventive method. In this case, an addition of Pb in an amount of up to 5 wt % is effective in order to promote bonding at low temperature. Further, it is preferable to actively utilize elements such as Mn, Pb, Zn, Be, Mo, W, Mg and Ag, a solid lubricant such as graphite, MnS and $CaF_2$ and/or hard dispersion materials such as ceramics.

The composite sintered contact component produced according to the twenty-six aspect of the invention may be formed into a cylindrical or substantially cylindrical shape by rounding after the sinter-bonding process (a twenty-seventh aspect of the invention).

BRIEF EXPLANATION OF THE DRAWINGS

FIG. 1(*a*) shows a Vickers hardness distribution of Fe—Al—Co ternary alloys which have been rapidly cooled subsequently to heating at 1,200° C.

FIG. 1(*b*) shows a Vickers hardness distribution of the Fe—Al—Co ternary alloys which have been subjected to aging treatment at 600° C. for 10 hours subsequently to the rapid cooling.

FIG. 7 shows a conceptual view of a tester for sliding tests and test conditions.

FIG. 14 is photographs showing the sintered structures (metallic structures) of various Fe base ordered phase sintered alloys.

FIG. 15 is a graph showing the effects of Si, Co and Ni upon the sinter-contractibility of Fe—Al base ordered phase sintered alloys.

FIG. 16 is a graph showing the seizure resistance of Fe base ordered phase sintered alloys having a porosity of about 10% by volume.

FIG. 17 is a graph showing the seizure resistance of Fe base ordered phase sintered alloys having a porosity of about 20% by volume.

BEST MODE FOR CARRYING OUT THE INVENTION

Figure 2:
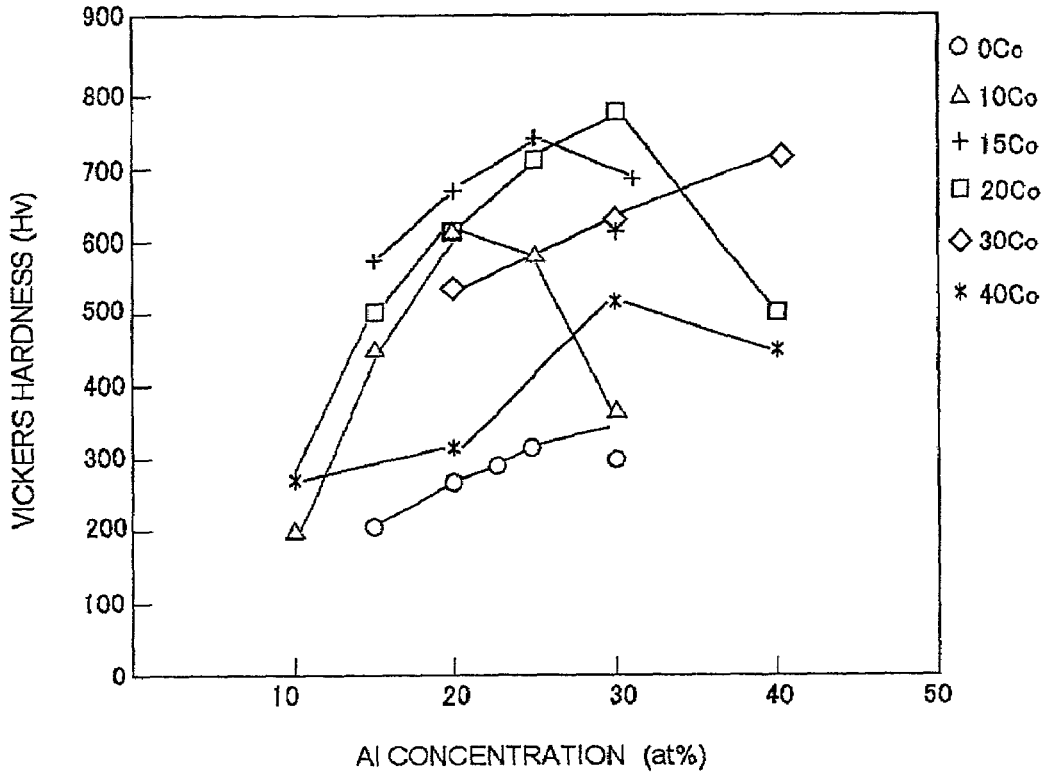
FIG. 2 is a graph showing the relationship between the concentration of Al (on an atom percentage basis) and hardness at the cross-sections of the alloys shown in FIG. 1(*b*) containing Cu in amounts of 0, 10, 15, 20, 30 and 40% by atom, respectively.

Referring now to the drawings, the contact material, composite sintered contact component and producing method of the invention will be described according to its preferred embodiments.

EXAMPLE 1

Various alloys having different compositions were prepared using electrolytic iron (99.95 wt %), Al and Co. These alloys were melted, produced and forged under a vacuum atmosphere and then cut into small pieces, forming specimens. The relationship between the magnetic transition temperature (Curie point (° C.)) and hardness of each alloy and thermal treatment was checked.

FIG. 1(*a*) shows the Vickers hardness distribution of Fe—Al—Co ternary alloys which contain 0 to 40% by atom Co and 0 to 40% by atom Al and were rapidly cooled after heating at 1,200° C. FIG. 1(*b*) shows the Vickers hardness distribution of these alloys which were further subjected to aging treatment at 600° C. for 10 hours after the rapid cooling. It is understood from these figures that while a slight tendency for hardening is found in the rapidly cooled alloys (shown in FIG. 1(*a*)) containing 25 to 40% by atom Al and 15 to 30% by atom Co, a significantly hardened zone exists in the alloys which underwent aging treatment at 600° C. (shown in FIG. 1(*b*)) and contain 15 to 40% by atom Al and 10 to 40% by atom Co.

FIG. 2 shows a plot of hardness versus Al concentration (on the basis of atom percentage) measured at the cross sections of the alloys shown in FIG. 1(*b*), the alloys containing Co in amounts of 0, 10, 15, 20, 30 and 40%, respectively. The following is understood from FIG. 2. In the case of the alloys containing 0% by atom Co (which means a case no Co was added), hardening proceeded as Al concentration increased. The degree of hardening in these alloys was substantially equal to the degree of the increase of Al concentration observed during the rapid cooling and therefore, virtually no hardening phenomenon caused by aging treatment at 600° C. was observed. Regarding the alloys containing 10% by atom Co, remarkable hardening was observed when 15% by atom Al (=about 8 wt % Al) was added, the peak hardness (Hv=620) was reached in the case of 20% by atom Al and age hardenability disappeared in the case of 30% by atom Al. When checking the effect of addition of Al on the alloys containing 20% by atom Co, age hardenability was observed in the alloys containing 10% by atom Al or more. When 30% by atom Al was added, the peak hardness (Hv=770) was reached and when 40% by atom Al was added, age hardenability substantially disappeared. Regarding the alloys containing 30% by atom Co, age hardenability was observed up to 40% by atom Al and remarkable age hardenability disappeared when Al content reached 40% by atom.

As understood from the above results, it is desirable that 10 to 30% by atom Co and 10 to 50% by atom Al be contained in order to effectively obtain age hardenability by addition of Co. It is apparent that the above-described remarkable age hardening phenomenon caused by addition of Co is attributable to the phase separation of the Fe base ordered phase, and the same phenomenon is confirmed in Fe—Al—Ni base alloys. It is thermodynamically anticipated that the same phenomenon can be attained by use of other alloy elements, namely, Si and Co in place of Al and Mn in place of Ni.

Figure 3:
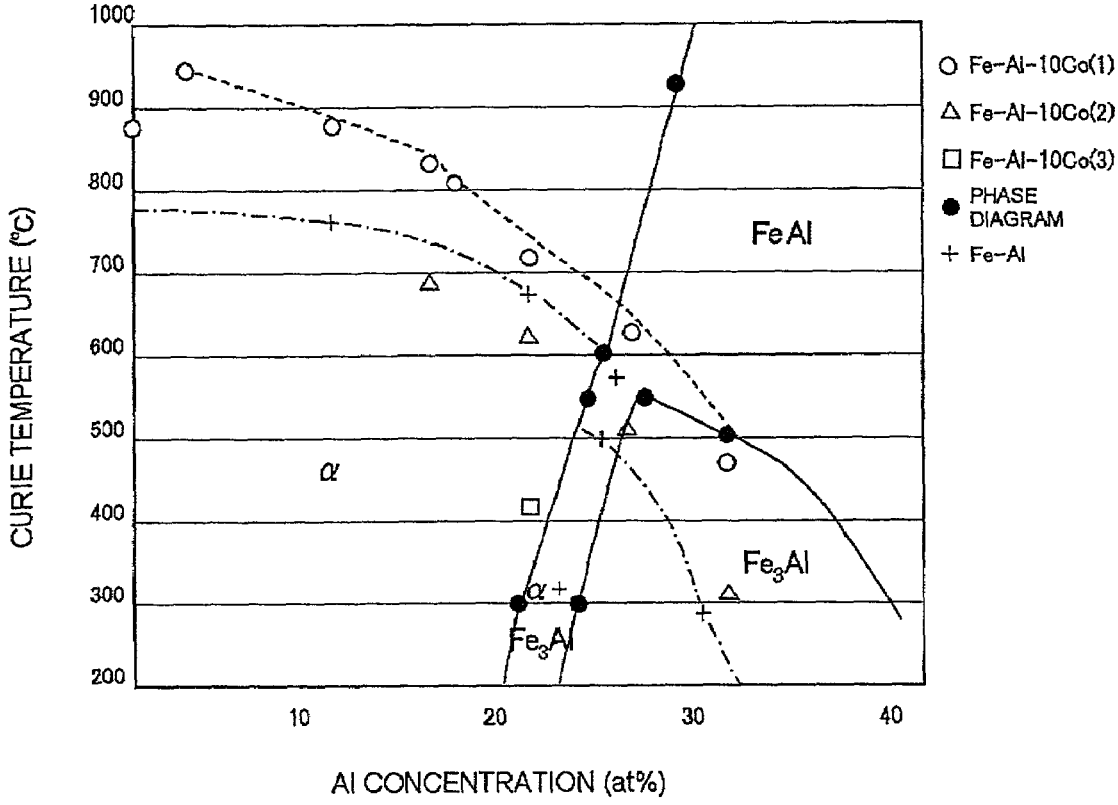
FIG. 3 is a graph showing the relationship between the Curie temperature and Al concentration (on an atom percentage basis) of Fe—Al-10Co alloys.

FIG. 3 shows a plot of Al concentration on the basis of atom percentage versus magnetic transition temperature (Curie temperature) obtained from a magnetization curve which is obtained when Fe—Al—Co ternary alloys containing 10% by atom Co were measured at a temperature rising and lowering speed of 5° C./min. As seen from FIG. 3, a plurality of magnetic transition points appeared in Fe-10% by atom Co-15% by atom Al alloys and three stages of magnetic transition temperatures were found in Fe-10% by atom Co-20% by atom Al alloys. It is understood from the above fact that three kinds of atomic arrangements are present, which are a disordered state, $Fe_3Al$ type and FeAl type. Further, since the appearance of the above three magnetic transition point stages translates into the higher temperature zone in cases where the amount of Co to be added is increased, it is understood that the ordered phase of Fe—Al alloys can be more stabilized by addition of Co.

EXAMPLE 2

Evaluations of the wear resistance of Fe ordered phases were conducted in the following procedure: Cylindrical specimens having a diameter of 10 mm and length of 50 mm were prepared from ingot materials of the compositions as shown in TABLE 1. After the hardness of these specimens had been adjusted by controlling the time required for age hardening at 500° C. and 600° C., the specimens of the contact materials were respectively pressed against a Portland cement disk containing 20 wt % SiC under an oil-lubricated condition. Then, the wear resistance of each material to sediment was evaluated.

TABLE 1

Fe BASE ORDERED PHASE ALLOY INGOT MATERIALS (wt %)

| No | Fe | Al | Co | Ni | Mn | Si | HARDNESS (Hv) |
|---|---|---|---|---|---|---|---|
| 1 | Bal. | 12 | | | | | 300 |
| 2 | Bal. | 12 | 20 | | | | 715 |
| 3 | Bal. | 12 | | 20 | | | 670 |
| 4 | Bal. | 12 | | | 10 | | 540 |
| 5 | Bal. | 10 | | | | 3 | 325 |

Figure 4:
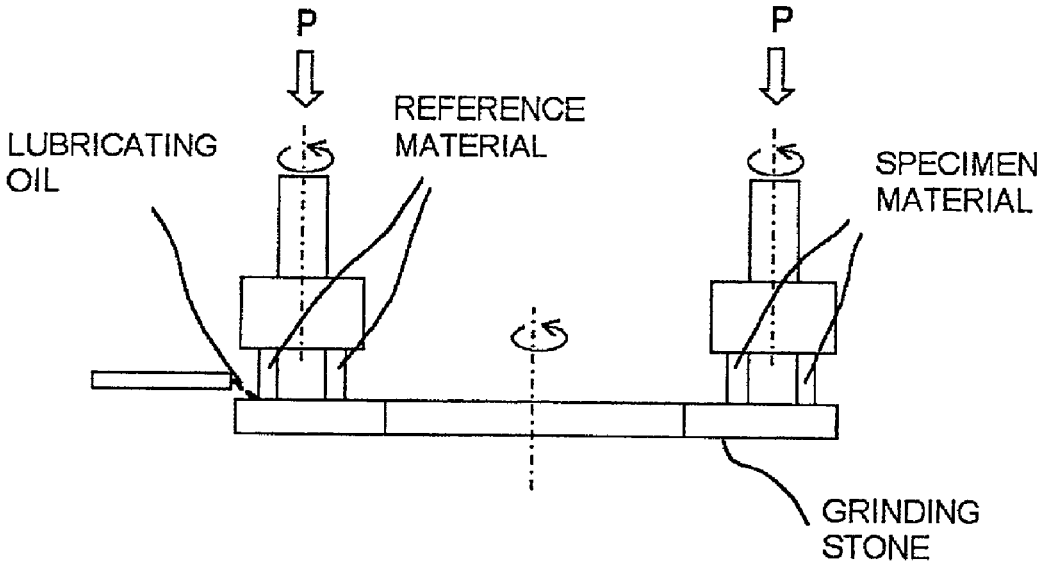
FIG. 4 shows a conceptual view of a tester for abrasion tests and test conditions.
Figure 5:
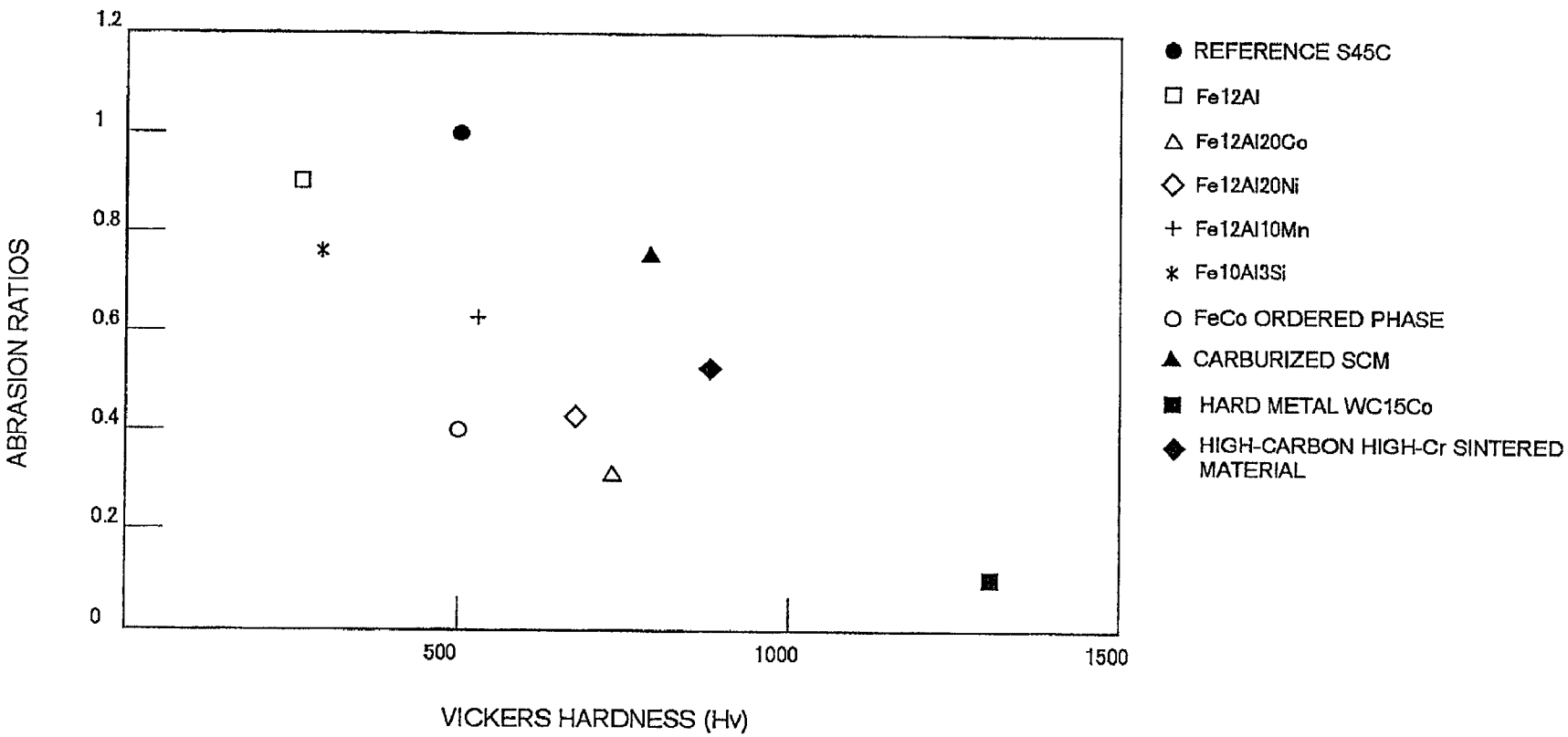
FIG. 5 is a graph showing the relationship between the hardness and wear ratio of Fe base ordered phase materials.

FIG. 4 shows a conceptual view of a tester and test conditions. In this test, a S45 comparative material which had undergone quenching and tempering so as to have a Vickers hardness of 500 was mounted on the tester together with the specimens, whereby the wear of each specimen was evaluated on the basis of the ratio of the wear amount of each specimen to the wear amount of the comparative material. FIG. 5 shows, as test results, the hardnesses of the Fe base ordered phase materials according to the invention in comparison with that of that of the comparative material. As seen from FIG. 5, the Fe base ordered phases exhibit excellent wear resistance for their hardnesses. The high-carbon, high-Cr sintered material of the comparative example is a mechanical sealing material which has a composition consisting of Fe, 3.0 wt % C, 0.3 wt % P, 15 wt % Cr, 2 wt % Ni, 1.5 wt % V, and 3.0 wt % Co. This mechanical sealing material is formed in such a way that quench-hardening is carried out by gas cooling after one-hour vacuum sintering at 1,180° C. and a large amount of $Cr_7C_3$ type carbide is precipitated to improve its wear resistance and seizure resistance.

EXAMPLE 3

Figure 6:
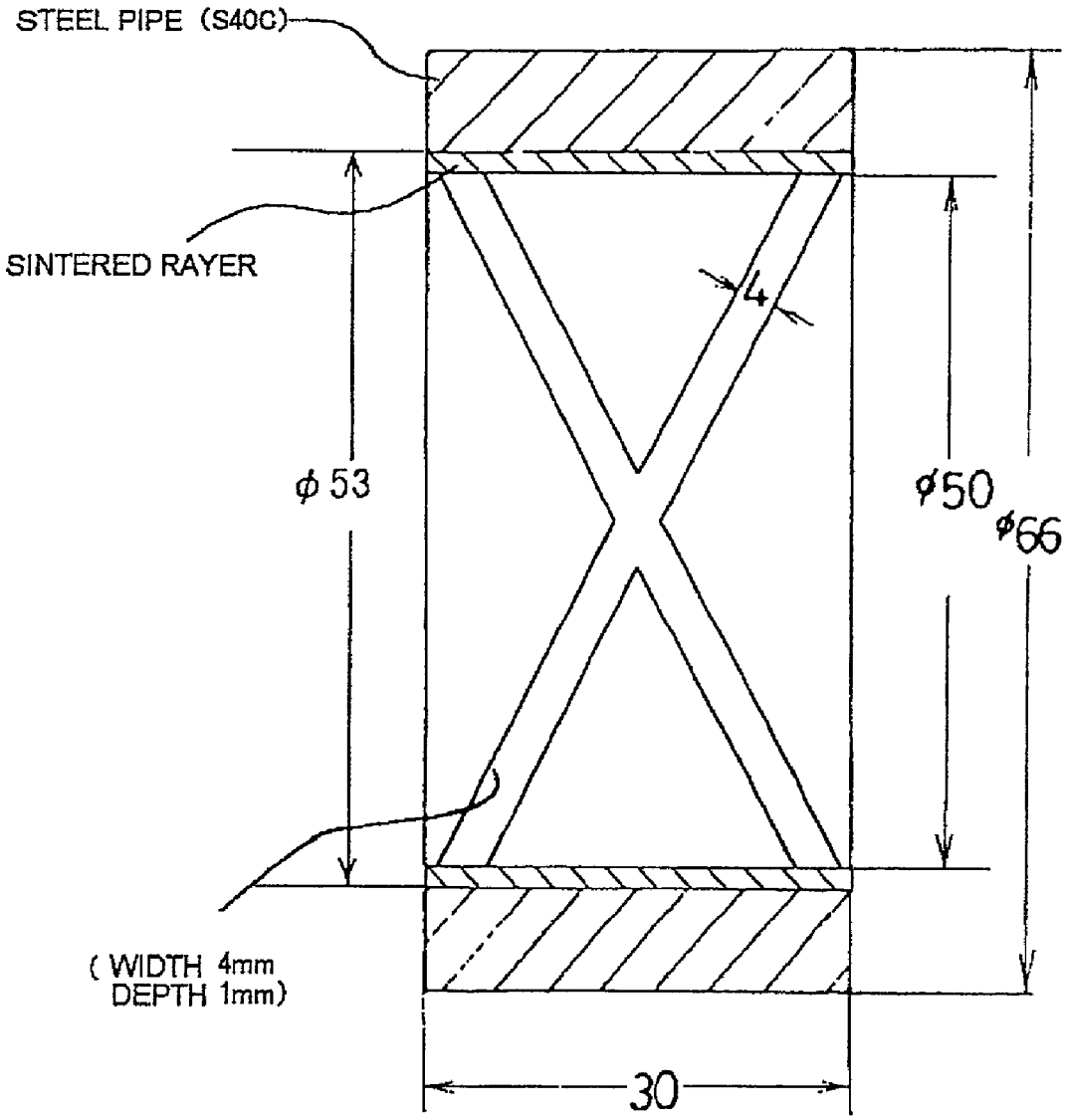
FIG. 6 is a sectional view of specimens used in sliding tests.

In this example, each of the alloys shown in TABLE 2 was melted in vacuum and then formed into a sheet-like shape by hot forging and hot rolling at 1,000 to 1,150° C. This sheet-like material was cut and rounded, thereby obtaining a bushing machined into the shape shown in FIG. 6. The bushings thus prepared were used as sliding test specimens and adjusted so as to have different hardnesses by controlling the processing time taken for aging at 600° C. Used as comparative examples were a carburized bushing (Comparative Example 1) formed from SCM420 case hardening steel and having a surface carbon concentration of about 0.8 wt %; an S43C quenched, tempered bushing (Comparative Example 2); and a high-strength brass quarternary material (Cu, 25 wt % Zn, 5 wt % Al, 3 wt % Mn, 2.5 wt % Fe) (Comparative Example 3).

TABLE 2

COMPOSITION OF Fe BASE ORDERED PHASE ALLOYS FOR SLIDING TESTS (wt %)

| No | Fe | Al | Cu | Co | Ni | Si | HARDNESS AFTER RAPID COOLING (Hv) | HARDNESS AFTER AGING (Hv) |
|---|---|---|---|---|---|---|---|---|
| 6 | Bal. | 5 | | | | | 170 | 175 |
| 7 | Bal. | 12 | | | | | 295 | 300 |
| 8 | Bal. | 12 | 10 | | | | 306 | 350 |
| 9 | Bal. | 8 | | 10 | | | 260 | 450 |

TABLE 2-continued

COMPOSITION OF Fe BASE ORDERED PHASE ALLOYS FOR SLIDING TESTS (wt %)

| No | Fe | Al | Cu | Co | Ni | Si | HARDNESS AFTER RAPID COOLING (Hv) | HARDNESS AFTER AGING (Hv) |
|---|---|---|---|---|---|---|---|---|
| 10 | Bal. | 12 | | 15 | | | 370 | 725 |
| 11 | Bal. | 12 | | | 20 | | 320 | 670 |
| COMPARATIVE MATERIAL 1: SCM420 + CARBURIZATION AND QUENCHING | | | | | | | | 770 |
| COMPARATIVE MATERIAL 2: S43C QUENCHING AND TEMPERING | | | | | | | | 550 |
| COMPARATIVE MATERIAL 3: HIGH-STRENGTH BRASS QUARTERNARY MATERIAL | | | | | | | | 230 |

FIG. 7 shows a conceptual view of a tester for sliding tests and test conditions. In the sliding tests, each bushing specimen reciprocates in a sliding manner 10,000 times for every pressure raise of 100 kg/cm$^2$ while sliding contact pressure being stepwise increased until it reached 1,000 kg/cm$^2$ with respect to the projected area of the bushing specimen. The tests were interrupted for evaluations, when seizure had occurred with an abrupt increase in the coefficient of friction or when progressive abrasion or abnormal noise had occurred.

Figure 8:
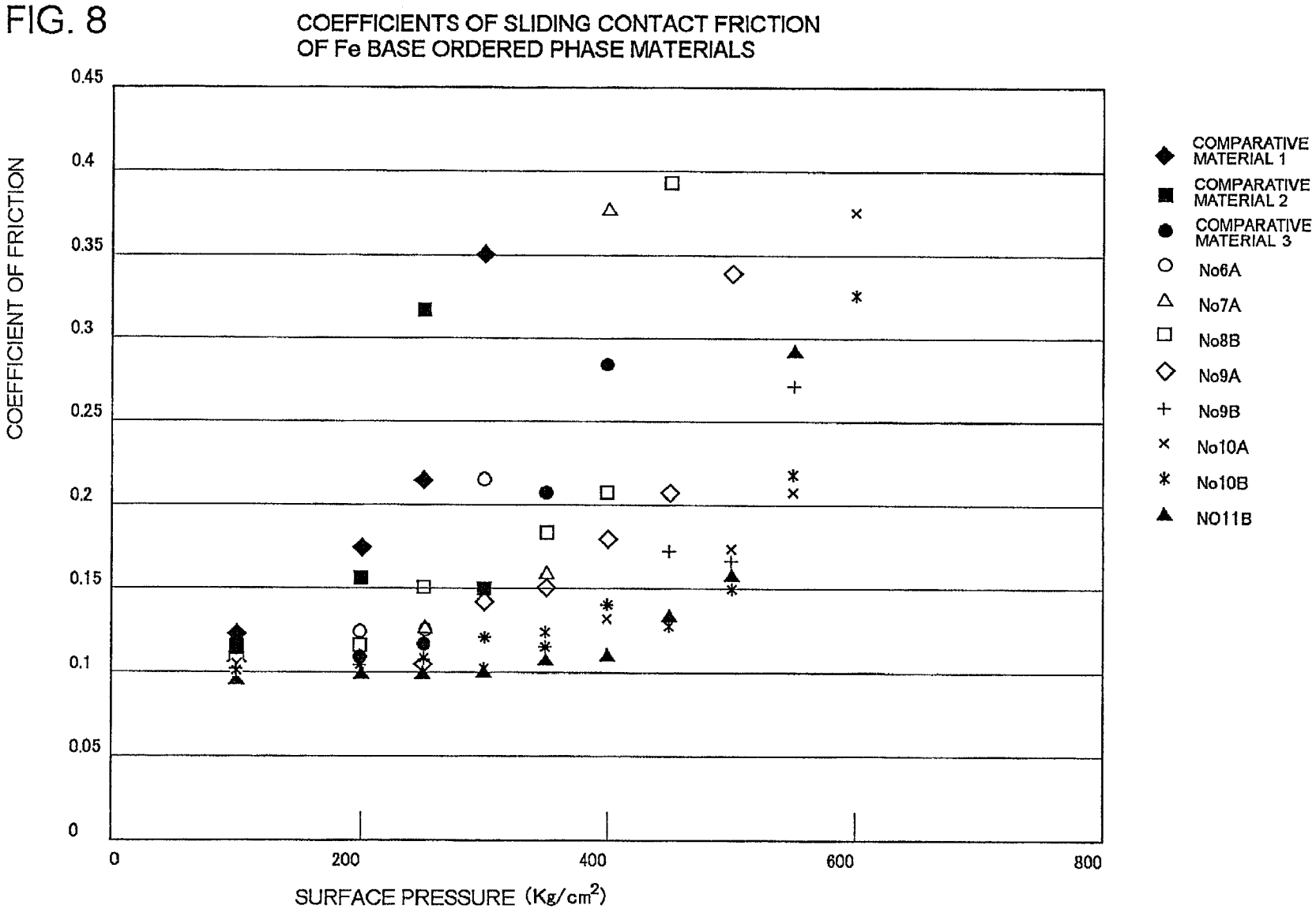
FIG. 8 is a graph showing a transition in the coefficients of sliding contact friction of Fe base ordered phase materials.
Figure 9:
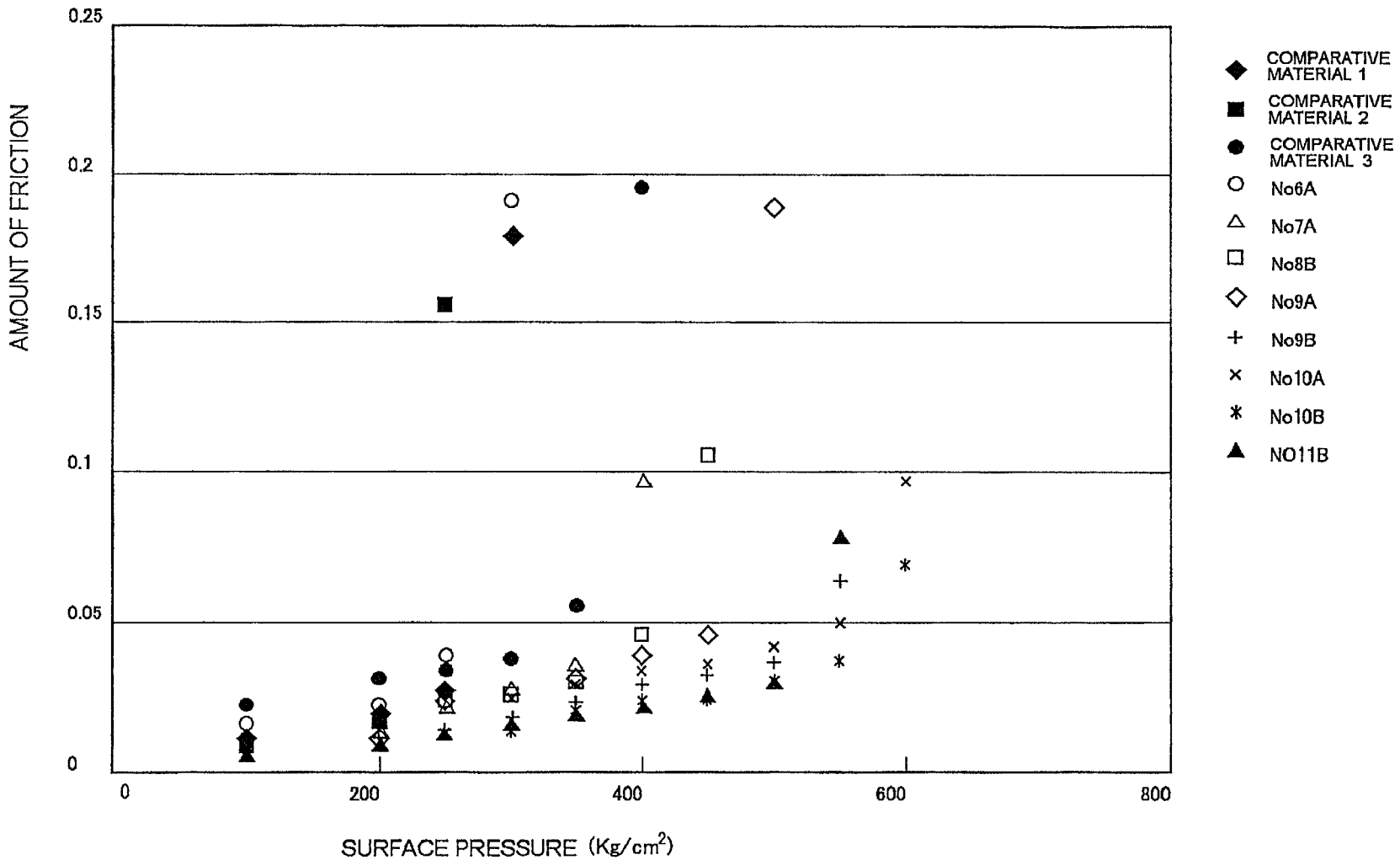
FIG. 9 is a graph showing a transition in the sliding contact abrasion amounts of Fe base ordered phase materials.

FIGS. 8 and 9 show a transition in the coefficient of sliding friction and a transition in the amount of wear caused by sliding, respectively. It is apparent from the test results that the inventive materials are superior to the comparative materials in terms of seizure resistance and that age hardening of the Fe ordered phases leads to improved wear resistance.

EXAMPLE 4

Figure 10:
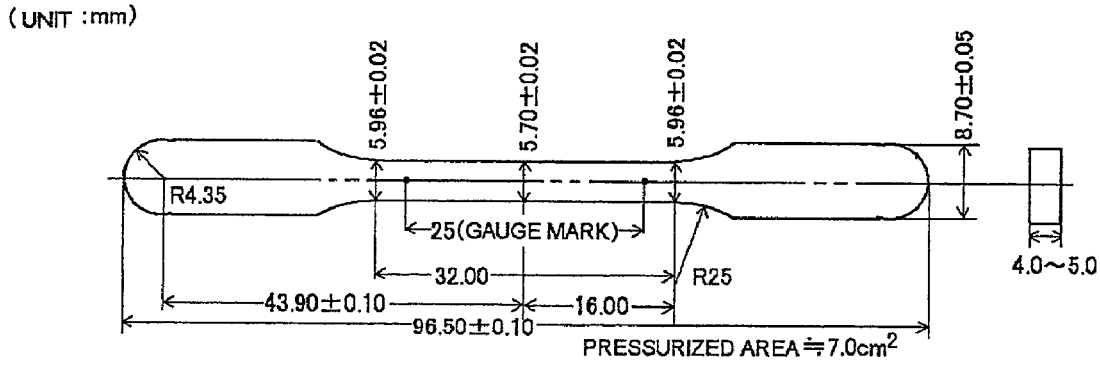
FIG. 10 shows the shape of specimens for tensile tests.

Blended Powders of the compositions shown in TABLES 3 and 4 were prepared, using a Fe atomized powder of 300 meshes or less, a Fe-10 wt % Al atomized powder, an Al atomized powder, a Sn atomized powder, a Ni-10P atomized powder, a Cu-8P atomized powder, a TiH powder of 300 meshes or less, phosphor iron (25 wt % P), a Si powder, a Mn powder, a carbonyl Ni powder of 5 μm, graphite having an average grain size of 6 μm and others. Each blended powder was compacted under a compaction pressure of 4 ton/cm$^2$ into a tensile test specimen (sliding test specimen in the form of a bushing) as shown in FIG. 10. The compacted bodies of these powders were sintered at 950 to 1,250° C. in a vacuum atmosphere of $10^{-1}$ torr or less for 10 minutes to one hour and after cooling by $N_2$ gas of 600 torr, the sizes and structures of them were checked.

TABLE 3

COMPOSITIONS OF FeAL BASE ORDERED PHASE SINTERED ALLOYS (wt %)(1)

| No | Fe (ASC300) | Al | Fe10Al | Fe17Al | Si | Fe27P | Cu (CE 15) | Cu8P | Sn | TiH | Co | Ni | Mn | GRAPHITE (KS6) | SIZE OF SPECIMEN COMPACTED UNDER COMPACT PRESSURE (5t/cm$^2$) |
|---|---|---|---|---|---|---|---|---|---|---|---|---|---|---|---|
| 1 | Bal. | 8 | | | | | | | | | | | | | 96.54 |
| 2 | Bal. | 12 | | | | | | | | | | | | | 96.53 |
| 3 | Bal. | 16 | | | | | | | | | | | | | 96.52 |
| 4 | Bal. | 12 | | | 1.5 | | | | | | | | | | 96.59 |
| 5 | Bal. | 12 | | | | 3 | | | | | | | | | 96.53 |
| 6 | Bal. | 12 | | | | | 10 | | | | | | | | 96.53 |
| 7 | Bal. | 12 | | | | | 20 | | | | | | | | 96.54 |
| 8 | Bal. | 12 | | | | | | 5 | | | | | | | 96.57 |
| 9 | Bal. | 12 | | | | | | 10 | | | | | | | 96.6 |
| 10 | Bal. | 12 | | | | | 10 | 10 | | | | | | | 96.58 |
| 11 | Bal. | 12 | | | | | | | 3 | | | | | | 96.52 |
| 12 | Bal. | 12 | | | | | 10 | | 3 | | | | | | 96.54 |
| 13 | Bal. | 12 | | | | | 20 | | 3 | | | | | | 96.53 |
| 14 | Bal. | 8 | | | | | 20 | | | | | | | | 96.54 |
| 15 | Bal. | 16 | | | | | 20 | | | | | | | | 96.53 |
| 16 | Bal. | 12 | | | | | 30 | | | | | | | | 96.54 |
| 17 | Bal. | 12 | | | | 3 | 20 | | | | | | | | 96.55 |
| | | | | | | | | | | | | | | | 4t/cm2 |
| 18 | Bal. | 12 | | | | 2 | 10 | | 1 | 0.2 | | | | | 96.55 |
| 19 | Bal. | 12 | | | | | 20 | | 2 | 0.2 | | | | | |
| 20 | Bal. | 12 | | | | | 30 | | 1 | 0.2 | | | | | |
| 21 | Bal. | 16 | | | | | 30 | | 1 | 0.2 | | | | | |
| 22 | Bal. | 16 | | | | | 30 | | 1 | 1 | | | | | |
| | | | | | | | | | | | | | | | 3t/cm$^2$ |
| 23 | Bal. | 3 | | | 10 | | 30 | | 2 | 0.2 | | | | | 96.55 |
| 24 | Bal. | 6 | | | 8 | | 30 | | 2 | 0.2 | | | | | |
| 25 | Bal. | 10 | | | 3 | | 30 | | 2 | 0.2 | | | | | |
| 26 | Bal. | 10 | | | 5 | | 30 | | 2 | 0.2 | | | | | |
| 27 | | 6 | 61.8 | | | | 30 | | 2 | 0.2 | | | | | |
| 28 | | | | 70 | | | 30 | | | | | | | | |
| 29 | Bal. | 12 | | | | | 30 | | 2 | 0.2 | 10 | | | | 96.58 |
| 30 | Bal. | 12 | | | | | 30 | | 2 | 0.2 | 20 | | | | 96.62 |
| 31 | Bal. | 12 | | | | | 30 | | 2 | 0.2 | | 10 | | | 96.55 |
| 32 | Bal. | 12 | | | | | 30 | | 2 | 0.2 | | 20 | | | 96.55 |
| 33 | Bal. | 12 | | | 1 | | 30 | | 2 | 0.2 | | | | | 96.53 |
| 34 | Bal. | 12 | | | 2 | | 30 | | 2 | 0.2 | | | | | 96.55 |
| 35 | Bal. | 12 | | | 3 | | 30 | | 2 | 0.2 | | | | | 96.58 |
| 36 | Bal. | 12 | | | 5 | | 30 | | 2 | 0.2 | | | | | 96.62 |

TABLE 3-continued

COMPOSITIONS OF FeAL BASE ORDERED PHASE SINTERED ALLOYS (wt %)(1)

| No | Fe (ASC300) | Al | Fe10Al | Fe17Al | Si | Fe27P | Cu (CE 15) | Cu8P | Sn | TiH | Co | Ni | Mn | GRAPHITE (KS6) | SIZE OF SPECIMEN COMPACTED UNDER COMPACT PRESSURE (5t/cm$^2$) |
|---|---|---|---|---|---|---|---|---|---|---|---|---|---|---|---|
| 37 | Bal. | 16 | | | 1 | | 30 | | 2 | 0.2 | | | | | 96.54 |
| 38 | Bal. | 16 | | | 2 | | 30 | | 2 | 0.2 | | | | | 96.54 |
| 39 | Bal. | 16 | | | 3 | | 30 | | 2 | 0.2 | | | | | 96.57 |
| 40 | Bal. | 16 | | | 5 | | 30 | | 2 | 0.2 | | | | | 96.65 |
| 41 | Bal. | 16 | | | 1 | | 20 | | 2 | 0.2 | | | | | 96.57 |
| 42 | Bal. | 16 | | | 2 | | 20 | | 2 | 0.2 | | | | | 96.58 |

TABLE 4

COMPOSITION OF FeAL BASE ORDERED PHASE SINTERED ALLOYS (wt %)(2)

| No | | | | | 1080° C. 2 h DIMEN-SION | 1140 1 hr | 1200 1 hr | 1250 1 hr | HARDNESS Hv5 Kg 1250° C. * 1 hr |
|---|---|---|---|---|---|---|---|---|---|
| 1 | | | | | 111.19 | 111.93 | 107.16 | 107.32 | |
| 2 | | | | | 114.71 | 114.23 | 109.38 | 112.34 | |
| 3 | | | | | 117.13 | 116.55 | 112.94 | 118.75 | |
| 4 | | | | | 117.62 | 116.95 | 114.56 | 112.86 | |
| 5 | | | | | 109.91 | 107.04 | 101.23 | 95.66 | 280 |
| 6 | | | | | 115.23 | 115.02 | 110 | 109.88 | |
| 7 | | | | | 108.53 | 105.54 | 100.24 | 98.82 | 177 |
| 8 | | | | | 115.34 | 115.71 | 109.91 | 09.28 | |
| 9 | | | | | 117 | 115.45 | 104.93 | 100.27 | |
| 10 | | | | | 109.86 | 105.14 | 97.53 | 96.35 | 275 |
| 11 | | | | | 115.81 | 117.29 | 116.97 | 115.61 | |
| 12 | | | | | 110.19 | 109.06 | 102.98 | 103.38 | |
| 13 | | | | | 105.24 | 102.45 | 96.66 | 95.4 | 225 |
| 14 | | | | | 98.34 | 97.37 | 95.44 | 94.96 | 172 |
| 15 | | | | | 115.57 | 113.62 | 106.29 | 99.81 | 175 |
| 16 | | | | | 99.07 | 98.03 | 96.16 | 95.68 | 281 |
| 17 | | | | | 105.57 | 102.72 | 96.91 | 96.82 | 310 |
| | 900° C. * 10 m | 950° C. * 10 m | 1000° C. * 10 m | 1050° C. * 10 m | 1100° C. * 10 m | 1150° C. * 10 m | 1200° C. * 10 m | | 1200° C. * 10 m |
| 18 | 118.69 | 119.41 | 115.7 | 117.24 | 119.51 | 115.08 | 107.93 | | 99 |
| 19 | 117.2 | 116.87 | 110.53 | 109.21 | 112.7 | 103.85 | 98.69 | | 190 |
| 20 | 112.47 | 112.13 | 108.69 | 103.52 | 105.5 | 97.6 | 94.17 | | 276 |
| 21 | 118.79 | 118.49 | 113.3 | 111.43 | 115.18 | 102.59 | 95.46 | | 232 |
| 22 | 117.47 | 117.38 | 112.35 | 111.08 | 113.92 | 102.04 | 95.23 | | 243 |
| | | 950° * 10 m | 1000° * 10 m | 1050° C. * 10 m | 1100° C. * 10 m | 1150° C. * 10 m | 30 m | | |
| 23 | | 104.29 | 100.78 | 98.57 | 98.76 | 94.59 | | ←SWELL | |
| 24 | | 105.73 | 99.13 | 97.6 | 95.84 | 92.73 | 89.49 | | |
| 25 | | 105.56 | 100.54 | 98.29 | 95.83 | 93.14 | 92.57 | | |
| 26 | | 106.99 | 101.71 | 98.75 | 95.85 | 93.34 | 92.85 | | |
| 27 | | 102.56 | 97.57 | 96.48 | 93.09 | 89.63 | 90.17 | | |
| 28 | | | | | | | | | |
| 29 | | | | | 98.75 | 98.05 | 96.5 | | 259 |
| 30 | | | | | 97.21 | 96.88 | 95.83 | | 272 |
| 31 | | | | | 97.42 | 95.30 | 93.4 | | 325 |
| 32 | | | | | 97.15 | 94.74 | 93.24 | | 313 |
| 33 | | 107.13 | 108.26 | 104.71 | 98.58 | 93.95 | 94.59 | | |
| 34 | | 106.35 | 109.09 | 103.56 | 97.77 | 93.58 | 94.18 | | |
| 35 | | 106.7 | 107.5 | 103.77 | 98.1 | 93.31 | 94.6 | | |
| 36 | | 108.15 | 109.2 | 105.06 | 99.21 | 93.73 | | | |
| 37 | | 112.32 | 115.22 | 113.2 | 105.1 | 97.49 | 99.47 | | |
| 38 | | 107.65 | 109.02 | 106.8 | 101 | 95.49 | 97.26 | | |
| 39 | | 106.39 | 107.26 | 105.36 | 99.81 | 94.99 | 95.24 | | |
| 40 | | 106.31 | 107.67 | 106.22 | 100.72 | 94.96 | 88.71 | | |
| 41 | | 113.65 | 115.68 | 113.73 | 108.85 | 103.41 | 103.42 | | |
| 42 | | 109.01 | 110.18 | 107.99 | 104.51 | 101.01 | 99.73 | | |

Figure 11:
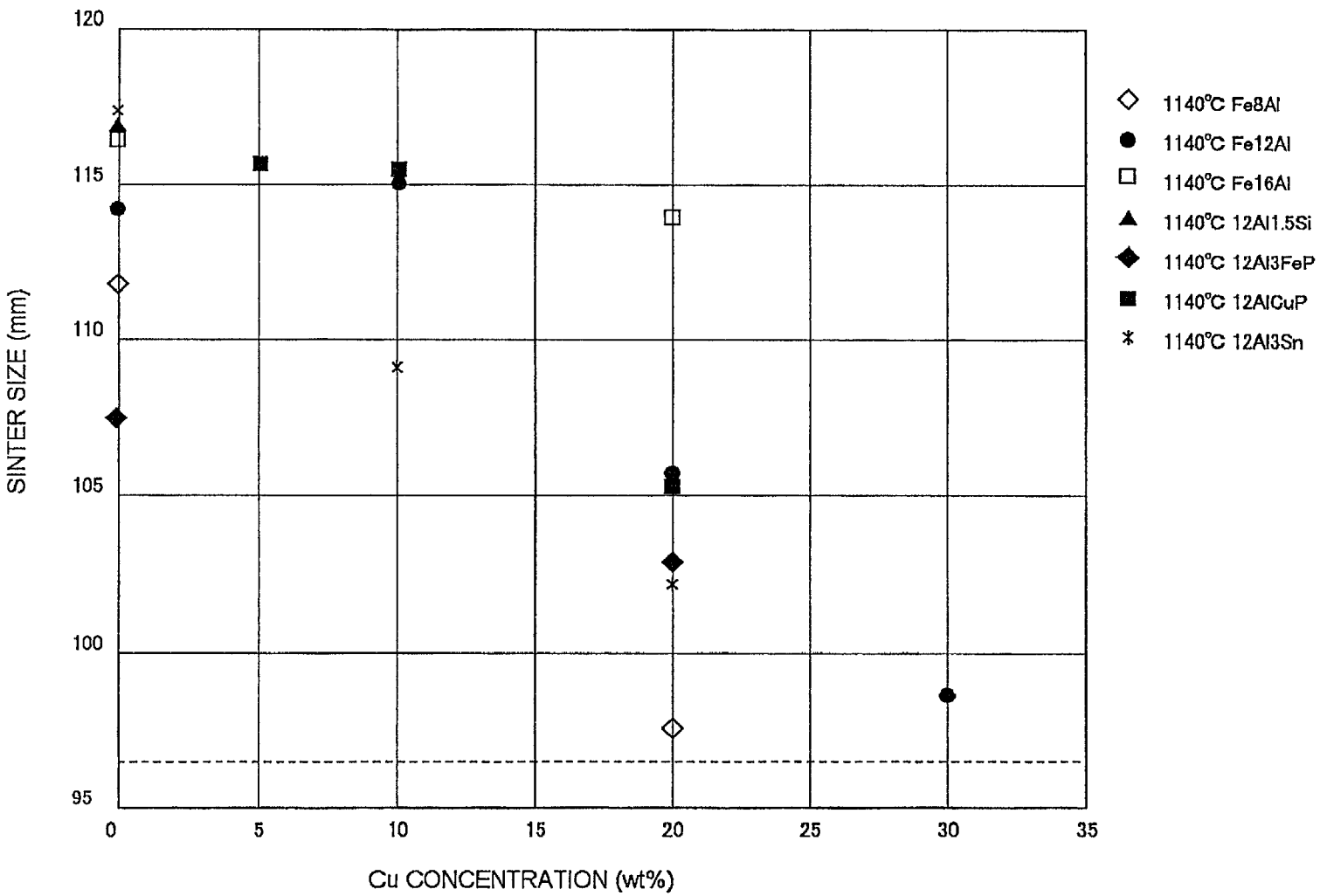
FIG. 11 is a graph showing the sintering properties of FeAlCu base materials (1,140° C.).
Figure 12:
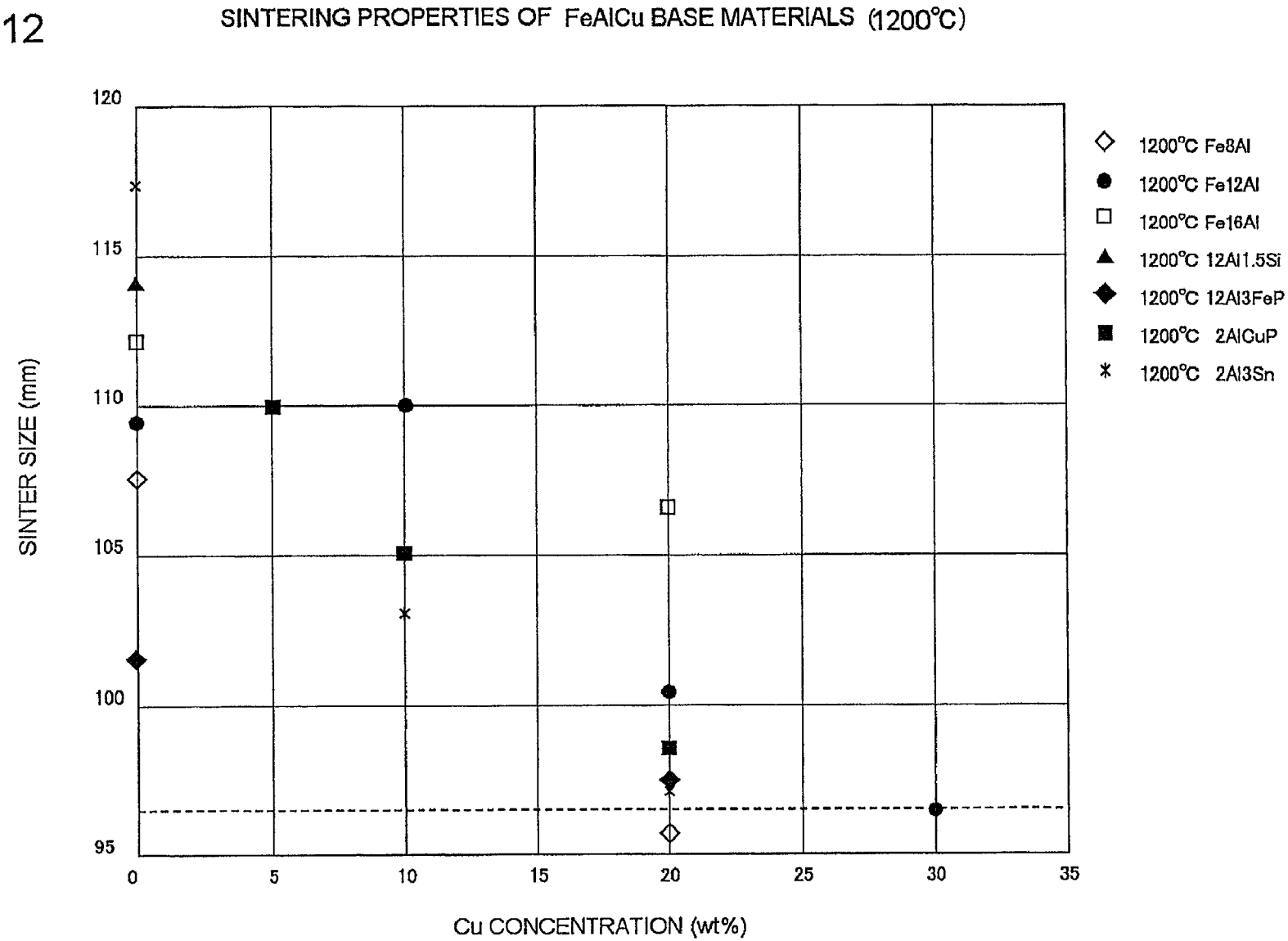
FIG. 12 is a graph showing the sintering properties of FeAlCu base materials (1,200° C.).
Figure 13:
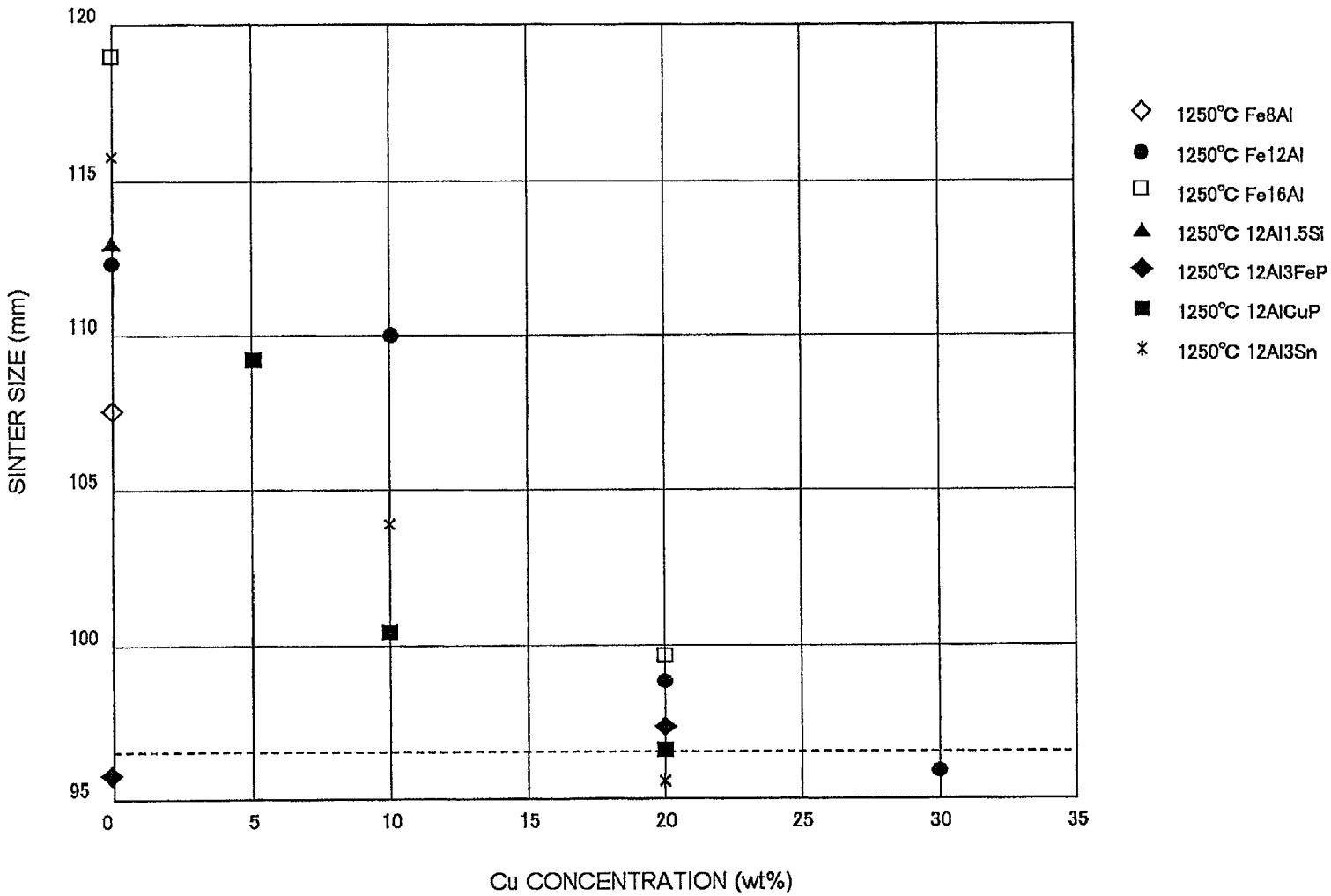
FIG. 13 is a graph showing the sintering properties of FeAlCu base materials (1,250° C.).

FIGS. 11 to 13 show the lengths of the tensile test specimens when they were vacuum sintered at 1,140° C., 1,200° C. and 1,250° C. for one hour. It is apparent from the results that, regarding the Fe—Al binary sintered alloys, sintered alloys prepared by blending Fe and Al primary powders were not shrunk from their compact length (=about 96.55 mm) indicated by broken line during sintering at a high temperature of 1,250° C. and exhibited remarkable expandability as previously reported, for instance, in a report written by D. J. Lee and R. M. German in American Powdery Metallurgy Institute Bulletin Vol. 21 (1985.9). In addition, in the case of sintered alloys in which Si and Sn, which exhibited thermodynamic rebound with respect to Al, were respectively solely added, remarkable expansion was not restricted. Sinter-contractibility was observed at 1,250° C. only where phosphor iron (Fe-25 wt % P) was added alone. Accordingly, it is apparently desirable to add small amounts of Al primary powder to Fe—Al binary alloy powders and binary alloy powders in order to obtain compact Fe—Al binary sintered alloys.

An investigation was made for checking the effect of addition of Cu upon improvements in the sinterability of Fe—Al sintered alloys formed from primary powders. It has been found from this investigation that a sole addition of Cu in amounts of less than 10 wt % does not lead to improved sinter-contractibility, but when Cu is added in amounts of 10 wt % or more, sinter-contractibility can be observed and satisfactory sinter-contractibility can be ensured by an addition of about 20 wt % Cu. The reason for this is that the amount of Cu—Al base alloy remaining as a phase within Fe—Al ordered phase particles becomes small as seen from the macrostructural photograph of the Fe-12 wt % Al-20 wt % Cu sintered alloy shown in FIG. 14. Accordingly, in order to enhance the sinterability of Fe—Al base sintered alloys, an addition of Cu in an amount of 10 wt % or more and more preferably in an amount of 20 wt % or more has proved to be necessary.

Further, by adding, together with Cu, an alloy element (e.g., Si, Sn, P, and Ti) which lowers the melting points of Cu alloys, the sinter-contractibility of the alloys is further improved so that sinter-contractibility can be ensured in the lower temperature zone.

TABLE 5 demonstrates the chemical compositions of the Fe—Al base ordered phases in the sintered alloys No. 18, 14, 20, 21, and 22 shown in TABLES 3 and 4 which have undergone 0.5-hour vacuum sintering at 1,200° C. and gas cooling. FIG. 5 also shows the chemical compositions of the Cu—Al base ordered phases which link the above Fe—Al base ordered phases, respectively. These chemical compositions were obtained by an analysis using an X-ray microanalyzer (EPMA analysis).

TABLE 5

RESULTS OF SEMI-QUANTITATIVE ANALYSIS (EDX) OF Fe—Al—Cu BASE BUSHING MATERIALS (wt %)

| PHASE | CONSTITUENTS | No. 18 | No. 14 | No. 20 | No. 21 | No. 22 |
|---|---|---|---|---|---|---|
| Fe ORDERED PHASE | Al K | 12.32 | 12.32 | 12.61 | 16.25 | 16.42 |
| | P K | 0.41 | 0.12 | 0.12 | 0.13 | 0.07 |
| | Sn L | 1.12 | 0.7 | 0.26 | 0.44 | 0.58 |
| | Ti K | 0.11 | 0.18 | 0.26 | 0.19 | 1.01 |
| | Fe K | 75.8 | 72.36 | 70.04 | 61.24 | 59.18 |
| | Cu K | 10.23 | 14.33 | 16.72 | 21.76 | 22.74 |
| BOUNDARY FACE PHASE | Al K | | 6.25 | 9.85 | 9.41 | 9.18 |
| | P K | | 0.07 | 0.13 | 0.07 | 0.05 |
| | Sn L | | 16.79 | 3.71 | 4.1 | 4.23 |
| | Ti K | | 1.52 | 0.08 | 0.11 | 0.09 |
| | Fe K | | 5.45 | 2.36 | 3.43 | 3.27 |
| | Cu K | | 69.92 | 83.86 | 82.87 | 83.18 |

As apparent from TABLE 5, Al and Ti are significantly condensed into the Fe—Al ordered phase rather than into the Cu—Al phase and Sn is condensed in the Cu—Al phase while Fe is dissolved in amounts of 3 to 5 wt % in a solid state. With reference to the HANSEN phase diagram, the Cu—Al phase contains about 9 wt % Al and elements such as Sn and Fe which stabilize the beta phase. From this, it is anticipated that the Cu—Al phase is substantially equivalent to the beta phase.

As already disclosed by the applicant in Japanese Patent Application No. 2000-86080, beta phase Cu—Al alloys exhibit excellent sliding properties and wear resistance as alloys subject to extremely severe oil lubricating conditions in which they slide at low sliding speed under high surface pressure, and in view of this, the above fact is greatly desirable. Since addition of Si, Sn and Ti markedly enhances the sinterability of the beta phase Cu—Al alloys and markedly promotes hardening, the amounts of these elements are preferably limited to 5 wt % or less.

FIG. 15 shows the effects of Si, Co and Ni on the sinter-contractibility of the Fe—Al base ordered phase sintered alloys formed by use of Fe and Al primary powders. It is understood from FIG. 15 that satisfactory sinter-contractibility can be also obtained by addition of Ni and Co which make age hardenability outstanding and that improved sinter-contractibility can be ensured by addition of Si. Si is a greatly favorable element in view of the fact that addition of Si in combination with Al forms an ordered phase, because Si is an element which forms a Fe—Si base ordered phase having the same crystal structure as that of Al.

FIG. 15 shows the sinter-contractibility of the ordered phase sintered alloy (i.e., the alloy No. 27 of TABLES 3 and 4) in which Fe 10 wt % Al alloy powder is used to restrict the amount of Al primary powder to be added. As seen from FIG. 15, this ordered phase sintered alloy exhibits contractibility superior to that of sintered alloys in which only a primary powder is added. It is apparent that if alloy powders such as, for instance, Fe—Al, Fe—Co—Al, Fe—Ni—Al and Fe—Al—Si are easily available, various Fe—Al base sintered alloys having good sinter-contractibility can be obtained by adding Cu or a Cu alloy powder to such alloy powders.

EXAMPLE 5

In this example, an investigation was made to check the sliding properties of sintered materials in which Fe-15Al and Fe-10Al-10Co base ordered phase alloy powders having a size of #100 meshes or less were respectively dispersed within the typical Fe—Al ordered phase sintered alloys shown in TABLES 3, 4 described in Example 4 and within the Cu alloy matrixes shown in TABLE 6. As a comparative example, a high-strength quarternary al (Cu-25 wt % Zn-5 wt % Al-3 wt % Mn-2.5 wt % Fe) was used.

TABLE 6

COMPOSITION OF Cu ALLOY SINTERED CONTACT MATERIALS IN WHICH ORDERED PHASE IS DISPERSED (wt %)

| No | Cu | Sn | Fe15Al | Fe10Al10Co |
|---|---|---|---|---|
| 43 | Bal. | 8 | 5 | |
| 44 | Bal. | 8 | 10 | |
| 45 | Bal. | 8 | 20 | |
| 46 | Bal. | 8 | 30 | |
| 47 | Bal. | 8 | | 10 |
| 48 | Bal. | 8 | | 20 |

Pressed compact bodies were prepared in such a way that cylindrical bodies having an outer diameter of 66 mm, inner diameter of 77 mm and height of 35 mm were compacted at a pressure of 4 ton/cm$^2$ and then vacuum-sintered so as to have porosities of about 10% by volume and 20% by volume followed by cooling with $N_2$ gas. Thereafter, these sintered bodies were formed into bushings having the shape shown in FIG. 6. Some of the brushings thus formed were impregnated with the lubricating oil #30. All the bushings underwent sliding tests. The tester and test conditions for the sliding tests are shown in FIG. 7 described above. The sliding contact surface pressure was stepwise increased until it reached 1,000 kg/cm$^2$ with respect to the projected area of each bushing specimen, while the bushing specimen reciprocating in a sliding manner 10,000 times for every pressure raise of 50 kg/cm$^2$. The tests were interrupted for evaluations when seizure had occurred with an abrupt increase in the coefficient of friction or when rapid abrasion or abnormal noise had occurred.

FIG. 16 shows the results of the tests in which the porosity of the specimens were adjusted to be about 10% by volume. As apparent from these results, most of the materials prepared according to the invention have higher resistance to high surface contact pressure causing seizure than the high-strength brass material. Particularly, Fe—Al—Cu, which does not contain Co, Ni or the like, has excellent seizure resistance compared to the materials shown in FIG. 8. The above findings are apparently attributable to the lubricating oil retained in the sintered bodies and it is obviously desirable to ensure a porosity of 5% by volume or more which at least allows the opening of the pores. It is understood from the test results of specimens No. 43 to 48 that markedly improved seizure resistance can be obtained even in the case of contact materials in which the Fe—Al ordered phase is dispersed in the Cu matrix and that the preferable Fe base ordered phase content of the contact materials is about 10 wt % or more (that is, approximately 10% by volume or more).

FIG. 17 shows the results of the sliding tests on the sintered materials in which the porosity was adjusted to be about 20% by volume and it is understood from this figure that seizure resistance could be more improved with a porosity of 20% by volume. However, if a porosity of 25% by volume or more is employed, a problem will presumably arise in the strength of the material when used as a bearing.

While it has been found from the test results of the above examples that the Fe base ordered phase itself has excellent sliding and abrasion resistance properties such as seizure resistance and wear resistance, it is also possible to develop a contact material in which a large amount of Cu is added to a Fe base ordered phase sintered alloy to link the Fe base ordered phase by the Cu phase as well as a contact material in which the amount of Cu is further increased to allow the Fe based ordered phase to be dispersed into the Cu phase. Conceivably, the amount of the Fe base order phase to be dispersed in this case is normally 10% by volume or more. A dispersion amount of 20% by volume or more is apparently more preferable.

EXAMPLE 6

TABLE 7 shows the compositions of the Fe based ordered phase sintered alloys used in the invention. Compacting of the blended powders was carried out in the following way. Each blended powder was compacted under a pressure of 2 ton/cm$^2$ into a cylindrical body having an outer diameter of 53 mm, inner diameter of 47 mm and height of 35 mm. Then, the compact thus formed was placed within the bore of a steel pipe (S45C) having an outer diameter of 66 mm, inner diameter of 53 mm and height of 40 mm and vacuum sintered at 1,150° C. for one hour followed by cooling with $N_2$ gas.

TABLE 7

COMPOSITON OF MATERIALS SINTER-BONDED TO AN INNER SURFACE (wt %)

| No | Fe | Al | Cu | Sn | Fe27P | Ti | Cr | Ni | GRAPHITE (SGO) | BONDING RATIO (%) |
|---|---|---|---|---|---|---|---|---|---|---|
| B1 | Bal. | 12 | 30 | 0.2 | | | | | | 63.2 |
| B2 | Bal. | 12 | 30 | 0.5 | | | | | | 88.1 |
| B3 | Bal. | 8 | 30 | 2 | | | | | | 92.3 |
| B4 | Bal. | 12 | 30 | 2 | | | | | | 93.6 |
| B5 | Bal. | 8 | 30 | 2 | 1 | | | | | 99.3 |
| B6 | Bal. | 12 | 30 | 2 | | 0.5 | | | | 98.2 |
| B7 | Bal. | 12 | 30 | 2 | | | 0.5 | | | 98.8 |
| B8 | Bal. | 12 | 30 | 2 | | | | 2 | | 96.4 |
| B9 | Bal. | 12 | 30 | 2 | | | | | 0.7 | 93.1 |
| B10 | Bal. | 12 | 30 | 2 | | 0.5 | | | 0.7 | 99.7 |
| B11 | Bal. | 12 | 30 | 2 | | | 0.5 | | 0.7 | 99.8 |

TABLE 7 shows the ratio of bonding between the steel pipe and the sintered layer of each specimen, the bonding ratio being evaluated using an ultrasonic inspector. As seen from TABLE 7, addition of Sn is extremely effective even in sinter bonding of a compact to a bore portion and the amount of Sn to be added is 0.2 wt % or more and, more desirably, 0.5 wt % or more. Further, addition of phosphor iron, Ti, Cr and Ni has proved to be effective in achieving a markedly improved bonding ratio, because these elements improve the wettability of the surface of the steel pipe which circumscribes the liquid phase generated during sintering. In addition, the conceivable reason why the bonding ratio did not sharply drop owing to the single addition of graphite is that the liquid phase containing a large amount of graphite and Sn is unlikely to be wet so that the liquid phase generated in the sintered body tends to be discharged into the interface between the liquid phase and the steep pipe. Further, where graphite and an alloy element which is highly reactive with graphite (e.g., Ti and Cr) are added in combination, the effect of graphite on Sn having a low melting point is first exerted and the action of Ti or Cr subsequently occurs, overlapping the effect of graphite, thereby achieving a further improvement in bonding.

It has been found that each specimen can be sinter bonded, in substantially the same manner as described earlier, to the inner circumferential surface of a steel pipe, the inner circumferential surface having been machined beforehand so as to have a spiral oil groove having a depth of about 1 mm and width of 5 mm. It has also been found that this steel pipe is applicable for an oil-less bearing for long use, by properly arranging the grooved portion so as to retain a lubricating oil.

EXAMPLE 7

In this example, sinter bonding tests were conducted through the following procedure. A Cu atomized powder having a particle size of 250 meshes or less, Sn atomized powder having a particle size of 250 meshes or less, Fe-15Al atomized powder having a particle size of 100 meshes or less and Fe-10Al-10Ni atomized powder having a particle size of 100 meshes or less were used to prepare blended powders shown in TABLE 6 explained in Example 5. Each blended powder was sinter bonded to a soft steel plate (SS400, thickness=3.5 mm, width=90 mm, length=300 mm) the surface of which had been roughened by the abrasive paper #400 and well washed using acetone.

In the test, each blended powder shown in TABLE 6 was sprayed onto the soft steel plate from 3 mm above and was subjected to sinter bonding at 850° C. for 20 minutes in a furnace atmosphere of ammonia cracked gas having a dew point of 38° C. Then, each sintered body was rolled by a rolling mill such that its sintered layer had a thickness of 1.7 mm and the rolled, powder-carried material was again sintered in the same manner. After the re-sintering process, the material was rounded into a cylindrical body having a diameter of 45 mm with the sintered layer positioned on the inside thereof. During the bending process, the peeling state of the sintered layer of each material with respect to the steel plate was checked. As a result, neither cracking nor peeling was observed in the bending process.

EXAMPLE 8

In this example, sinter bonding tests were conducted as follows. A Fe atomized powder having a particle size of 100 meshes or less, Cu atomized powder having a particle size of 250 meshes or less, Sn atomized powder having a particle size of 250 meshes or less, Fe-15Al atomized powder having a particle size of 100 meshes or less and Fe-10Al-10Ni atomized powder having a particle size of 100 meshes or less were used to prepare blended powders shown in TABLE 8. Each blended powder was sinter bonded to the same steel plate as in Example 7. The sintering temperature was 900° C. The peeling state of the sintered layer of each material was checked after rounding. As a result, no peeling was observed.

TABLE 8

COMPOSITIONS OF MATERIALS SINTER-BONDED TO A STEEL PLATE (wt %)

| No | Fe | Fe15Al | Fe10Al10Ni | Cu | Sn |
|---|---|---|---|---|---|
| C1 | Bal. | 5 | | 30 | 5 |
| C2 | Bal. | 10 | | 30 | 5 |
| C3 | Bal. | 20 | | 30 | 5 |
| C4 | Bal. | 30 | | 30 | 5 |
| C5 | Bal. | | 20 | 30 | 5 |

Figure 18:
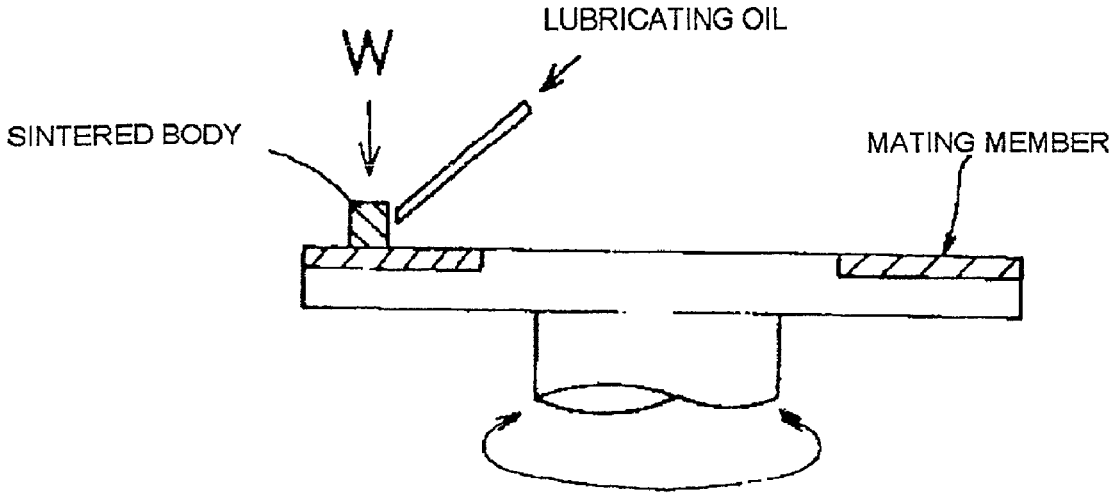
FIG. 18 shows a constant speed friction abrasion tester and test conditions.
Figure 19:
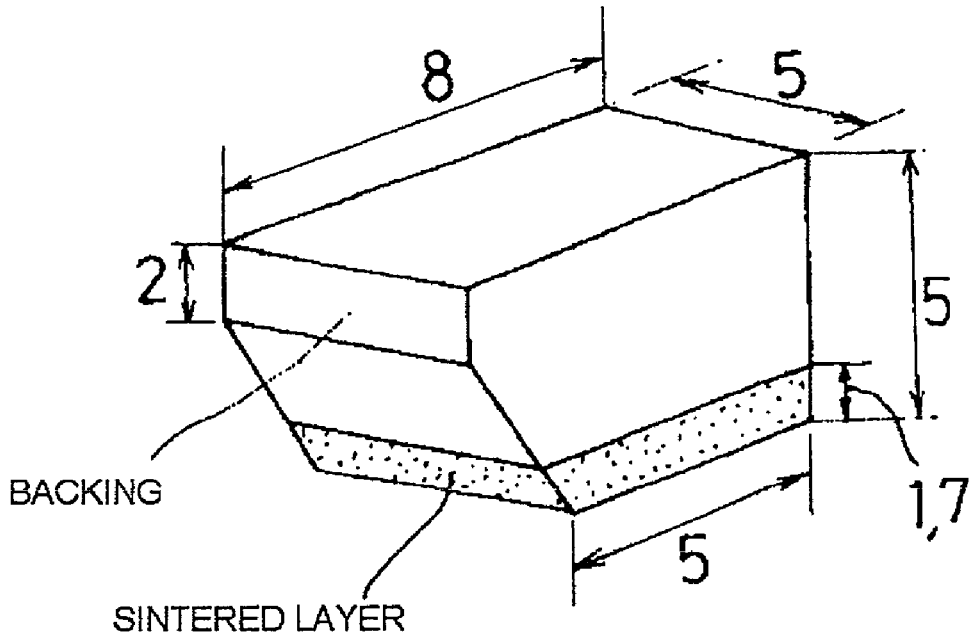
FIG. 19 shows the shape of sliding test specimens used in constant speed friction abrasion tests.
Figure 20:
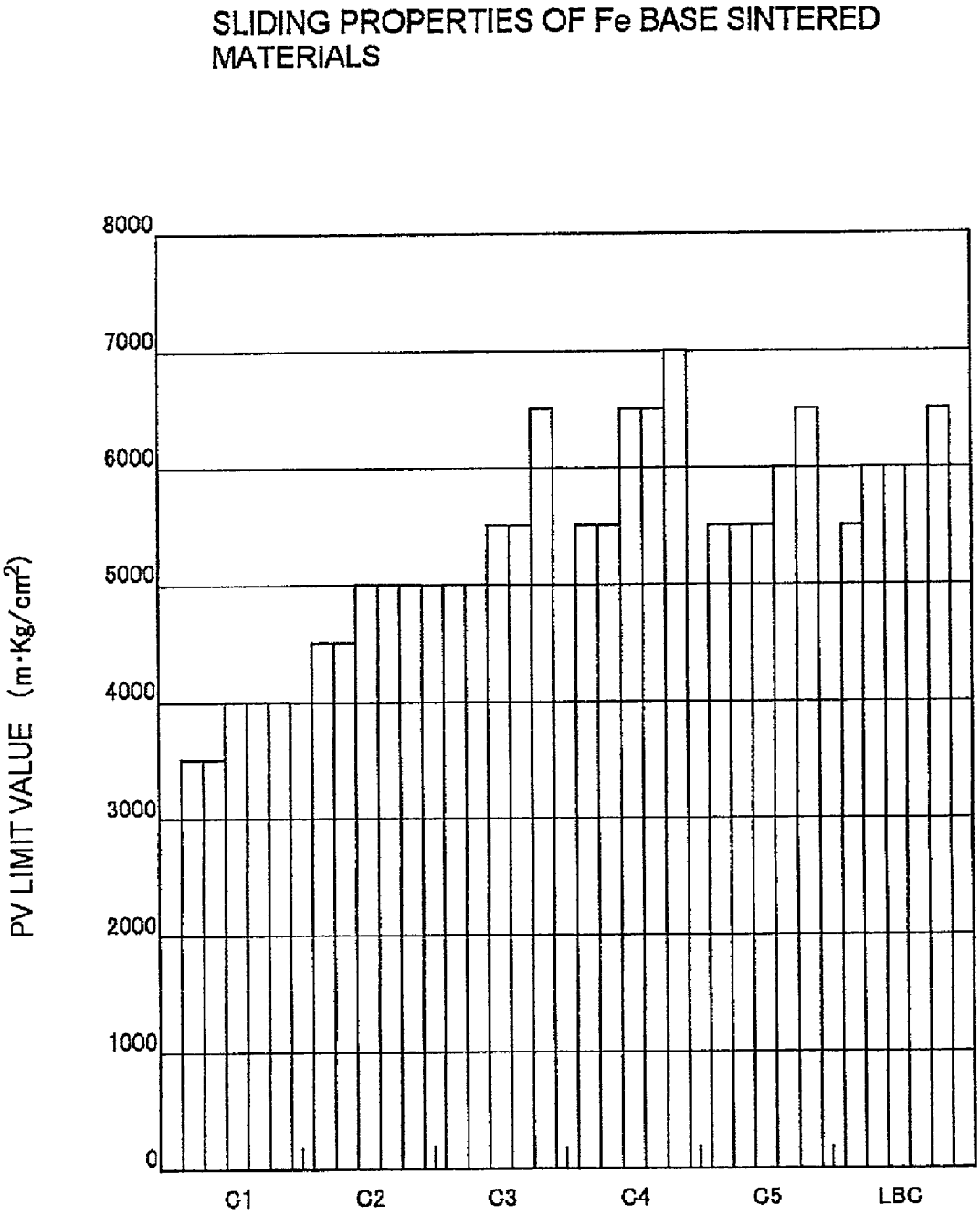
FIG. 20 is a graph showing the sliding properties of Fe base sintered materials.

Next, the sliding properties of sliding test specimens shown in FIG. 19 were investigated, employing the constant speed friction abrasion tester and test conditions shown in FIG. 18. As a comparative example, a lead-bronze sintered material (LBC) having a composition of Cu-10 wt % Sn-10 wt % Pb and sinter-bonded to a steel plate was used. FIG. 20 shows the investigation results of the PV values (PV limit) of the specimens measured at the instant when abnormal abrasion and an abnormal increase in the coefficient of friction occurred. It is understood from the results that improved sliding properties can be achieved by addition of 5 wt % or more the Fe-15Al ordered phase alloy powder, but the more preferable amount of the Fe-15Al ordered phase alloy powder is 10 wt % or more.

What is claimed is:

1. A composite sintered contact component, wherein a sintered contact material, containing 10% by volume or more a Fe base alloy phase having a composition range which causes an order-disorder transition, is integrated with a sheet-like, cylindrical or substantially cylindrical backing made from an iron base material, wherein said Fe base alloy phase contains Fe as a chief component and at least 12 to 30 wt % Al, and wherein the porosity of said composite sintered contact component is adjusted to be 10 to 35% by volume.

2. A composite sintered contact component, wherein a sintered contact material, containing 10% by volume or more a Fe base alloy phase having a composition range which causes an order-disorder transition, is integrated with a sheet-like, cylindrical or substantially cylindrical backing made from an iron base material, and wherein said Fe base alloy phase contains Fe as a chief component and at least 12 to 30 wt % Al, wherein said sintered contact material is sinter-bonded to the backing in independently dispersed island form in an amount of 30 to 70% by area with respect to the area of the backing, and recesses formed between the independent islands of the contact material are filled with grease or a solid lubricant while the contact material is sliding.

3. A composite sintered contact component, wherein a sintered contact material, containing 10% by volume or more a Fe base alloy phase having a composition range which causes an order-disorder transition, is integrated with a sheet-like, cylindrical or substantially cylindrical backing made from an iron base material, and wherein said Fe base alloy phase contains Fe as a chief component and at least 12 to 30 wt % Al, wherein said sintered contact material is holed, making independent recesses in an amount of 30 to 70% by area with respect to the area of the backing and sinter-bonded to the backing, and the independent recesses are filled with grease or a solid lubricant while the contact material is sliding.

4. A composite sintered contact component according to claim 1, wherein reservoir grooves for lubricating oil are preformed in the joint surface of the backing.

5. A composite sintered contact component according to claim 1, wherein the porosity of the composite sintered contact component is adjusted to be greater than 10 to 35% by volume.

6. A composite sintered contact component according to claim 1, wherein the iron base material of the backing has a porosity of 5 to 30% by volume so that the backing portion of the component also retains oil.

7. A composite sintered contact component according to claim 1, which contains at least 10 to 90 wt % Cu and in which the Fe base alloy phase and a Cu alloy phase are dispersed in an amount of 10% by volume or more within the structure of the contact material.

8. A composite sintered contact component according to claim 1, further comprising one or more elements selected from the group consisting of elements such as C, Cr, Pb, Zn, Be, Mo, W, Mg and Ag; solid lubricants such as graphite, MnS and $CaF_2$; and hard dispersion materials such as ceramics.

9. A composite sintered contact component according to any one of claims 1 or 6, wherein said sintered contact material is sinter-bonded to the backing through a third insert material.

10. A composite sintered contact component according to any one of claims 1 or 6, wherein the backing is provided with a collar so as to slide when it is subjected to a thrust load and a wear-resistant contact material is integrated with the sliding contact surface of the collar.

11. A composite sintered contact component according to claim 10, wherein said wear-resistant contact material is one selected from the group consisting of hard metals, stellite, iron base wear-resistant materials, ceramics and wear-resistant Cu infiltrated materials and is integrated by one means selected from thermal spraying, brazing, sinter-bonding, infiltration and adhesion.

12. A composite sintered contact component, wherein a sintered contact material, containing 10% by volume or more a Fe base alloy phase having a composition range which causes an order-disorder transition, is integrated with a sheet-like, cylindrical or substantially cylindrical backing made from an iron base material, and wherein said Fe base alloy phase contains Fe as a chief component and at least 12 to 30 wt % Al.

13. A composite sintered contact component according to claim 12, wherein the Fe base alloy phase contains Fe as a chief component and greater than 12 to 30 wt % Al.

* * * * *

UNITED STATES PATENT AND TRADEMARK OFFICE

CERTIFICATE OF CORRECTION

PATENT NO. : 7,078,107 B2
APPLICATION NO. : 10/011815
DATED : July 18, 2006
INVENTOR(S) : Takemori Takayama et al.

It is certified that error appears in the above-identified patent and that said Letters Patent is hereby corrected as shown below:

Column 23:
Line 27, “claims 1 or 6” should read -- claims 1 to 6 --.

Column 24
Line 2, “claims 1 or 6” should read -- claims 1 to 6 --.

Signed and Sealed this

Thirteenth Day of March, 2007

JON W. DUDAS
*Director of the United States Patent and Trademark Office*